US008088022B2

(12) United States Patent
Soracco et al.

(10) Patent No.: US 8,088,022 B2
(45) **Date of Patent: *Jan. 3, 2012**

(54) GOLF CLUB HEAD WITH TOP LINE INSERT

(75) Inventors: Peter L. Soracco, Carlsbad, CA (US); Ryan L. Roach, Carlsbad, CA (US); Thomas C. Morris, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 234 days.

This patent is subject to a terminal disclaimer.

(21) Appl. No.: 12/362,666

(22) Filed: Jan. 30, 2009

(65) Prior Publication Data

US 2009/0221382 A1 Sep. 3, 2009

Related U.S. Application Data

(63) Continuation-in-part of application No. 11/896,237, filed on Aug. 30, 2007, which is a continuation-in-part of application No. 11/266,172, filed on Nov. 4, 2005, now Pat. No. 7,524,250, which is a continuation-in-part of application No. 10/843,622, filed on May 12, 2004, now Pat. No. 7,481,718.

(51) Int. Cl.
*A63B 53/04* (2006.01)

(52) U.S. Cl. ..... 473/332; 473/349; 473/350

(58) Field of Classification Search ..... 473/324–350, 473/287–292

See application file for complete search history.

(56) References Cited

U.S. PATENT DOCUMENTS

| | | | | |
|---|---|---|---|---|
| 1,319,233 | A | 10/1919 | Mattern | 473/337 |
| 1,534,600 | A | 4/1925 | Mattern | |
| 2,429,351 | A | 10/1947 | Fetterolf | 473/329 |
| 3,084,940 | A | 4/1963 | Cissel | 473/332 |
| 3,881,733 | A | 5/1975 | Csernits | 473/330 |
| 3,970,236 | A | 7/1976 | Rogers | 228/196 |
| 4,027,885 | A | 6/1977 | Rogers | 473/342 |
| 4,340,230 | A | 7/1982 | Churchward | 473/339 |
| 4,398,965 | A | 8/1983 | Campau | 148/522 |
| 4,523,759 | A | 6/1985 | Igarashi | 473/346 |
| 4,607,846 | A | 8/1986 | Perkins | 473/336 |

(Continued)

FOREIGN PATENT DOCUMENTS

JP 04-082576 3/1992

(Continued)

OTHER PUBLICATIONS

U.S. Patent Publication No. 2008/0015051.

(Continued)

*Primary Examiner* — Sebastiano Passaniti

(74) *Attorney, Agent, or Firm* — Mark S. Leonardo; Brown Rudnick LLP

(57) ABSTRACT

A golf club head having a recess located in a top portion thereof between the heel and the toe and extending toward the sole. The recess may be only in the top line of the club head or extend from the heel around the toe. An insert may be placed within the recess. The insert may have a density that is less than the density of the club head body to lower the center of gravity and moment of inertia or greater than the density of the club head body to raise the center of gravity and moment of inertia.

20 Claims, 13 Drawing Sheets

U.S. PATENT DOCUMENTS

| | | | | |
|---|---|---|---|---|
| 4,687,205 | A | 8/1987 | Tominaga et al. | |
| 4,811,950 | A | 3/1989 | Kobayashi | |
| 4,874,171 | A | 10/1989 | Ezaki et al. | |
| 4,928,972 | A | 5/1990 | Nakanishi et al. | 473/332 |
| 4,957,294 | A | 9/1990 | Long | |
| D321,920 | S | 11/1991 | Parente et al. | D21/748 |
| 5,110,131 | A | 5/1992 | Long | |
| 5,221,087 | A | 6/1993 | Fenton et al. | 473/342 |
| D339,183 | S | 9/1993 | Stites, III | D21/748 |
| D343,216 | S | 1/1994 | Chorne | D21/748 |
| 5,303,922 | A | 4/1994 | Lo | |
| 5,316,298 | A | 5/1994 | Hutin et al. | 473/332 |
| 5,377,979 | A | 1/1995 | Long | 473/310 |
| 5,377,985 | A | 1/1995 | Ohnishi | |
| 5,413,336 | A | 5/1995 | Iwanaga | |
| 5,439,223 | A | 8/1995 | Kobayashi | |
| 5,492,327 | A | 2/1996 | Biafore | 473/332 |
| 5,544,885 | A | 8/1996 | Besnard et al. | 473/350 |
| 5,564,705 | A | 10/1996 | Kobayashi et al. | 473/334 |
| 5,586,947 | A | 12/1996 | Hutin | 473/324 |
| 5,616,088 | A | 4/1997 | Aizawa et al. | 473/341 |
| 5,643,112 | A | 7/1997 | Basnard et al. | |
| 5,669,826 | A | 9/1997 | Chang et al. | 473/332 |
| 5,772,527 | A | 6/1998 | Liu | 73/324 |
| 5,938,540 | A | 8/1999 | Lu | |
| 6,042,486 | A | 3/2000 | Gallagher | 473/329 |
| 6,080,069 | A | 6/2000 | Long | 473/332 |
| 6,093,112 | A * | 7/2000 | Peters et al. | 473/291 |
| RE36,950 | E | 11/2000 | Allen | 473/314 |
| 6,302,807 | B1 | 10/2001 | Rohrer | 473/329 |
| 6,306,048 | B1 | 10/2001 | McCabe et al. | |
| 6,332,848 | B1 | 12/2001 | Long et al. | |
| 6,443,857 | B1 | 9/2002 | Chuang | 473/332 |
| 6,478,690 | B2 | 11/2002 | Helmstetter et al. | |
| 6,592,469 | B2 | 7/2003 | Gilbert | 473/350 |
| 6,688,989 | B2 | 2/2004 | Best | 473/332 |
| 6,702,693 | B2 | 3/2004 | Bamber | |
| 6,769,998 | B2 | 8/2004 | Clausen et al. | |
| 6,773,361 | B1 | 8/2004 | Lee | 473/335 |
| 6,814,674 | B2 | 11/2004 | Clausen et al. | |
| 6,830,519 | B2 | 12/2004 | Reed et al. | |
| 6,902,495 | B2 | 6/2005 | Pergande et al. | 473/332 |
| 6,921,344 | B2 | 7/2005 | Gilbert et al. | 473/334 |
| 6,929,563 | B2 | 8/2005 | Nishitani | |
| 7,014,571 | B2 | 3/2006 | Deshmukh | |
| 7,048,648 | B2 | 5/2006 | Breier et al. | 473/340 |
| 7,244,188 | B2 | 7/2007 | Best | |
| 7,303,486 | B2 | 12/2007 | Imamoto | 473/332 |
| 7,481,718 | B2 | 1/2009 | Soracco | 473/332 |
| 7,524,250 | B2 | 4/2009 | Soracco et al. | 473/349 |
| 7,588,503 | B2 | 9/2009 | Roach et al. | |
| 7,621,822 | B2 | 11/2009 | Roach | 473/329 |
| 7,686,704 | B2 * | 3/2010 | Gilbert et al. | 473/290 |
| 7,938,737 | B2 | 5/2011 | Soracco et al. | |
| 2002/0107087 | A1 | 8/2002 | Fagot | |
| 2002/0165041 | A1 | 11/2002 | Takeda | |
| 2004/0023730 | A1 | 2/2004 | Nagai et al. | |
| 2004/0116200 | A1 | 6/2004 | Helmstetter et al. | |
| 2004/0204263 | A1 * | 10/2004 | Fagot et al. | 473/291 |
| 2005/0143190 | A1 | 6/2005 | Takeda | |
| 2006/0025234 | A1 | 2/2006 | Nicolette et al. | |
| 2006/0052184 | A1 | 3/2006 | Soracco | |
| 2008/0051220 | A1 | 2/2008 | Soracco | |
| 2010/0056297 | A1 | 3/2010 | Roach | |

FOREIGN PATENT DOCUMENTS

| | | |
|---|---|---|
| JP | 05-168732 | 7/1993 |
| JP | 07-031697 | 2/1995 |
| JP | 07-213656 | 8/1995 |
| JP | 08-024379 | 1/1996 |
| JP | 08-057088 | 3/1996 |
| JP | 08-206258 | 8/1996 |
| JP | 08-257181 | 10/1996 |
| JP | 3032837 | 10/1996 |
| JP | 09-173513 | 7/1997 |
| JP | 09-225075 | 9/1997 |
| JP | 11-226158 | 8/1999 |
| JP | 2000-153008 | 6/2000 |
| JP | 2001-161870 | 6/2001 |
| JP | 2003-093550 | 4/2003 |
| JP | 2006-300589 | 11/2006 |
| JP | 3145482 | 9/2008 |
| WO | WO 2005/082062 | 9/2005 |
| WO | WO 2005-082062 | 9/2005 |

OTHER PUBLICATIONS

Non-Final Office Action dated Mar. 17, 2010 of corresponding U.S. Appl. No. 11/266,172.
U.S. Patent Publication No. 2007/0129166 A1.
U.S. Patent Publication No. 2005/0277485.
U.S. Patent Publication No. 2005/0277484 A1.
U.S. Patent Publication No. 2005/0096151 A1.
U.S. Patent Publication No. 2003/0125129 A1.
U.S. Patent Publication No. 2003/0092502 A1.
U.S. Patent Publication No. 2003/0045372 A1.
U.S. Patent Publication No. 2003/0032499 A1.
U.S. Patent Publication No. 2002/0094883 A1.
U.S. Patent Publication No. 2002/0042307 A1.
Non-Final Office Action dated Sep. 14, 2009 of corresponding U.S. Appl. No. 11/896,237.
Non-Final Office Action dated Nov. 28, 2007 of corresponding U.S. Appl. No. 11/266,172.
Non-Final Office Action dated Jun. 11, 2008 of corresponding U.S. Appl. No. 11/266,172.
Notice of Allowance dated Dec. 30, 2008 of corresponding U.S. Appl. No. 11/266,172.
Non-Final Office Action dated Apr. 18, 2005 of corresponding U.S. Appl. No. 10/843,622.
Non-Final Office Action dated Nov. 22, 2005 of corresponding U.S. Appl. No. 10/843,622.
Non-Final Office Action dated Jun. 15, 2006 of corresponding U.S. Appl. No. 10/843,622.
Final Office Action dated Feb. 9, 2007 of corresponding U.S. Appl. No. 10/843,622.
Advisory Action dated May 17, 2007 of corresponding U.S. Appl. No. 10/843,622.
Non-Final Office Action dated Aug. 22, 2007 of corresponding U.S. Appl. No. 10/843,622.
Final Office Action dated Feb. 4, 2008 of corresponding U.S. Appl. No. 10/843,622.
Notice of Allowance dated Oct. 2, 2008 of corresponding U.S. Appl. No. 10/843,622.
Japanese Office Action dated Dec. 1, 2008 of corresponding Japanese Patent Application No. 2006-300589.
Japanese Office Action dated Aug. 2, 2010 of corresponding Japanese Patent Application No. 2006-300589.
Japanese Office Action dated Dec. 20, 2010 (mailed Jan. 11, 2011) of corresponding Japanese Patent Application No. 2006-300589 (Trial No. 2009-20956).
U. S. Office Action Dated Jul. 18, 2008 in U.S. Appl. No. 10/843,622.
U. S. Office Action Dated Dec. 12, 2007 in U.S. Appl. No. 11/266,180.
U. S. Office Action Dated Jul. 9, 2008 in U.S. Appl. No. 11/266,180.
U. S. Office Action Dated Sep. 8, 2008 in U.S. Appl. No. 11/266,180.
U. S. Office Action Dated Apr. 14, 2009 in U.S. Appl. No. 11/266,180.
U. S. Office Action, BPAI, *Pre-Brief Conference Decision*, dated Nov. 9, 2009 in U.S. Appl. No. 11/266,180.
U. S. Office Action, BPAI, *Appeal Brief* Dated Dec. 2, 2009 in U.S. Appl. No. 11/266,180.
U. S. Office Action, BPAI, *Supplemental Appeal Brief*, dated Dec. 18, 2009 in U.S. Appl. No. 11/266,180.
U. S. Office Action, BPAI, Advisory Action, dated Jun. 26, 2009 in U.S. Appl. No. 11/266,180.
U. S. Office Action, BPAI, *Amendment (after Final) to Advisory Action*, dated Jul. 14, 2009 in U.S. Appl. No. 11/266,180.
U. S. Office Action, BPAI, *Docketing Notice*, dated Aug. 3, 2010 in U.S. Appl. No. 11/266,180.
U. S. Office Action, BPAI, *Reply Brief Noted*, dated Jul. 16, 2010 in U.S. Appl. No. 11/266,180.

U. S. Office Action, BPAI, *Appellants Reply Brief*, dated May 13, 2010 in U.S. Appl. No. 11/266,180.

U. S. Office Action, BPAI, *Examiner's Answer to Appeal Brief*, dted Mar. 15, 2010 in U.S. Appl. No. 11/266,180.

U.S. Office Action dated Mar. 17, 2010 of corresponding U.S. Appl. No. 11/896,237.

U.S. Office Action dated Jul. 30, 2010 of corresponding U.S. Appl. No. 11/896,237.

U.S. Notice of Allowance dated Jan. 19, 2011 of corresponding U.S. Appl. No. 11/896,237.

U. S. Office Action dated Jun. 7, 2010 in U.S. Appl. No. 12/553,977.

U. S. Final Office Action dated Jan. 18, 2011 in U.S. Appl. No. 12/553,977.

U. S. Notice of Allowance dated May 10, 2011 in U.S. Appl. No. 12/553,977.

* cited by examiner

GOLF CLUB HEAD WITH TOP LINE INSERT

CROSS-REFERENCE TO RELATED APPLICATIONS

This is a continuation-in-part of U.S. patent application Ser. No. 11/896,237, filed Aug. 30, 2007, now pending, which is a continuation-in-part of U.S. patent application Ser. No. 11/266,172, filed Nov. 4, 2005 U.S. Pat. No. 7,524,250, which is a continuation-in-part of U.S. patent application Ser. No. 10/843,622, filed May 12, 2004 U.S. Pat. No. 7,481,718, which are incorporated herein by reference in their entireties.

FIELD OF THE INVENTION

The present invention relates to a golf club, and, more particularly, to a golf club head having a top line recess with an insert. In particular, the golf club head of the present invention is directed to a design including a top line with a recess and an optional insert that extend along at least a portion of the top line around the toe. In addition, the present invention relates to a set of golf clubs with a recess and insert in the top line where the higher loft angle clubs have a heavier or higher specific gravity insert and the lower loft angle clubs have a lighter or lower specific gravity insert.

BACKGROUND OF THE INVENTION

Golf club heads come in many different forms and makes, such as wood- or metal-type, iron-type (including wedge-type club heads), utility- or specialty-type, and putter-type. Each of these styles has a prescribed function and make-up. For example, iron-type and utility-type golf club heads generally include a front or striking face, a top line, and a sole. The front face interfaces with and strikes the golf ball. The angle between the face and a vertical plane is called the loft angle.

A plurality of grooves, sometimes referred to as "score lines," may be provided on the face to assist in imparting spin to the ball. A portion of the face may have an area with a different type of surface treatment that extends fractionally beyond the score line extents. In addition, the top line is generally configured to have a particular look to the golfer and to provide structural rigidity for the striking face. Some club heads have the surface treatment wrap onto the top line. The sole of the golf club is particularly important to the golf shot because it contacts and interacts with the ground during the swing.

In conventional sets of iron-type golf clubs, the club heads are attached to a shaft, which has a grip attached to the other end. The set generally includes irons that are designated number 3 through number 9, and a pitching wedge. Higher loft angle clubs are generally called "short irons" because the higher loft angle results in a shorter overall shot distance. Lower loft angle clubs are generally referred to as "long irons" because these types of clubs usually result in a longer overall distance. Each iron has a shaft length that usually decreases through the set as the loft for each club head increases from the long irons to the short irons. One or more additional long irons, such as those designated number 1 or number 2, and wedges, such as a gap wedge, a sand wedge, and a lob wedge, may optionally be included with the set. Alternatively, the set may include irons that are designated number 4 through number 9, a pitching wedge, and a gap wedge.

The overall weight of each club head generally increases through the set as the shaft length decreases from the long irons to the short irons. To properly ensure that each club has a similar feel or balance during a golf swing, a measurement known as "swingweight" is often used as a criterion to define the club head weight and the shaft length. Because each of the clubs within the set is typically designed to have the same swingweight value for each different lofted club head or given shaft length, the weight of the club head is confined to a particular range.

The length of the shaft, along with the club head loft, moment of inertia, and center of gravity location, impart various performance characteristics to the ball's launch conditions upon impact and dictate the golf ball's launch angle, spin rate, flight trajectory, and the distance the ball will travel. For example, flight distance generally increases with a decrease in loft angle and an increase in club length. However, difficulty of use also increases with a decrease in loft angle and an increase in club length.

Iron-type golf clubs generally can be divided into three categories: blades and muscle backs, conventional cavity backs, and modern multi-material cavity backs. Blades are traditional clubs with a substantially uniform appearance from the sole to the top line, although there may be some tapering from sole to top line. Similarly, muscle backs are substantially uniform, but have extra material on the back thereof in the form of a rib that can be used to lower the club head center of gravity. A club head with a lower center of gravity than the ball center of gravity facilitates getting the golf ball airborne. Because blade and muscle back designs have a small sweet spot, which is a term that refers to the area of the face that results in a desirable golf shot upon striking a golf ball, these designs are relatively difficult to wield and are typically only used by skilled golfers. However, these designs allow the skilled golfer to work the ball and shape the golf shot as desired.

Cavity backs move some of the club mass to the perimeter of the club by providing a hollow or cavity in the back of the club, opposite the striking face. The perimeter weighting created by the cavity increases the club's moment of inertia (a measurement of the club's resistance to torque), thus producing a more forgiving club with a larger sweet spot. The decrease in club head mass resulting from the cavity also allows the size of the club face to be increased, further enlarging the sweet spot. As such, these clubs are easier to hit than blades and muscle backs, and are therefore more readily usable by less-skilled and beginner golfers.

Modern multi-material cavity backs are the latest attempt by golf club designers to make cavity backs more forgiving and easier to hit. Some of these designs replace certain areas of the club head, such as the striking face or sole, with a second material that can be either heavier or lighter than the first material. These designs can also contain deep undercuts, which stem from the rear cavity, or secondary cavities. By incorporating materials of varying densities or providing cavities and undercuts, mass can be freed up to increase the overall size of the club head, expand the sweet spot, enhance the moment of inertia, and/or optimize the club head center of gravity location. However, due to construction limitations or requirements, some of these designs inadvertently thicken the top portion of the club head. Still, these improvements make the multi-material cavity back design the easiest of all styles to hit, and are ideally suited for the less adroit or novice golfer.

As mentioned above, producing a low center of gravity in a club head increases its playability. One of the ways to lower the center of gravity is to lower the face profile of the head. However, this produces a club head with a bad aesthetic appearance. Another method of reducing the club's center of gravity is to reduce the height of the hosel. However, there are disadvantages to reducing the hosel height, such as: reduced moment of inertia (since hosel mass is far away from the center of gravity); shaft-bonding concerns; and the inability to customize the club head via bending for loft/lie. In addition, many golfers dislike the appearance of a club head that has a very small hosel.

As such, there remains a need in the art for a club head that has a modified top line such that the resulting club has a desirable center of gravity location and remains aesthetically appealing to the golfer.

SUMMARY OF THE INVENTION

The present invention relates to a golf club head having a body defining a front surface, a top line, a sole, a back, a heel, a toe, and a hosel. The top portion of the club head, preferably the top line, contains a recess therein located between the heel and the toe, and extending toward the sole. Additional recesses, such as a toe recess and a heel recess, may also be provided in the top portion of the club head. In addition, the recess may extend along the top line from the heel around the toe of the top line. The use of such recesses remove material from the club head, allowing the opportunity to do one or more of the following: increase the size of the overall club head, expand the size of the club head sweet spot, lower the club head center of gravity, and/or produce a greater moment of inertia measured about a vertical or horizontal axis passing through the club head center of gravity. The golf club head of the present invention preferably is an iron-type, a utility-type, or a putter-type golf club head.

Inserts formed of a secondary material may be placed within the recesses. In one embodiment, these inserts have a density that is less than the density of the material used to form the club head body, and the inserts preferably are lightweight inserts. This allows the mass removed by the recesses to be replaced in more desirous locations on the club head, such as in the perimeter and/or toward the sole. The inserts may contain one or more dampening materials, such as a viscoelastic material, which have the added benefit of dissipating vibrations that may be created during the golf shot. Nylon is one example of a suitable insert material according to the invention. The incorporation of such dampening materials provides improved feel and improved weight distribution, enhancing performance of the club, while still maintaining an aesthetically pleasing overall head shape. The incorporation of the dampening materials also improves wearing of the heads over time since the viscoelastic material covers the top-toe area of the club, which is primarily responsible for marks on the head due to club-to-club impacts as the clubs rest in a player's bag.

In another aspect of the invention, the inserts extend to areas under the top line, thus allowing for the removal of even more mass from the top portion of the club head while permitting traditional methods of club head adjustment. For example, the lie and loft are typically adjusted using a device that clamps down on the top line. However, by setting some of the insert below the metallic top line, the clamp will not damage or disfigure the top line. The lightweight insert allows for mass to be removed from the top line and redistributed to other areas of the club to optimize center of gravity and moment of inertia, as well as expand the sweet spot of the club head.

In another embodiment, the insert is formed of a material that has a greater density than the material used to form the body of the club head. In this aspect of the invention, the present invention contemplates a set of golf clubs where the higher loft clubs include a recess with a high specific gravity insert in order to increase the center of gravity. In this aspect of the invention, the lower loft angle clubs (long irons) may have a lower center of gravity than the higher loft angle clubs (short irons). In particular, the long irons are equipped with a low specific gravity top line insert and the short irons are equipped with a high specific gravity top line insert.

Instead of a recess, an extension may be provided at the top portion of the club head where relatively high density metallic material has been removed. The insert may then be attached to the extension.

The present invention is also directed to an iron-type golf club head, including:

a body defining a top line including a recess, wherein the body is formed of a first material with a first specific gravity;

an insert positioned within the top line recess, wherein the top line insert is formed of a second material with a second specific gravity, wherein the second specific gravity is different than the first specific gravity, and wherein the club head satisfies the relationship:

$$I_{zz} \geqq CG_z * 170$$

where $I_{zz}$ is the rotational moment of inertia about a vertical axis and has units of g/cm2 and $CG_z$ is the center of gravity and has units of mm.

In one embodiment, the golf club head further includes a sole including a heel recess and a toe recess and a weight insert positioned within the sole heel recess and the sole toe recess, wherein the weight insert formed of a third material with a third specific gravity. The third specific gravity may be at least about 7. In one embodiment, the third specific gravity may be at least about 9. In another embodiment, the second specific gravity may be greater than the first specific gravity by at least about 3.

In this aspect of the invention, the club head may satisfy the relationship $I_{zz} \geqq CG_z * SG * 17$, wherein SG is the second specific gravity. In one embodiment, the second specific gravity is less than the first specific gravity by at least about 3.

In one embodiment, the club head satisfies the relationship $I_{zz} \geqq CG_z * SG * 130$, wherein SG is the second specific gravity. In another embodiment, the $I_{zz}$ is at least about 2500 $g \cdot cm^2$. In yet another embodiment, the second specific gravity is less than about 1.5. In still another embodiment, the second specific gravity is greater than about 9. The recess may extend from the heel around the top line-toe transition.

The present invention is also directed to a set of iron type golf clubs including at least one club including a first club head including: a body defining a top line including a recess, wherein the body is formed of a first material with a first specific gravity; an insert positioned within the recess, wherein the insert has a second specific gravity, and wherein the second specific gravity is less than the first specific gravity; and at least one club including a second club head including: a body defining a top line including a recess, wherein the body is formed of a third material with a third specific gravity; an insert positioned within the recess, wherein the insert has a fourth specific gravity, and wherein the fourth specific gravity is greater than the third specific gravity.

In one embodiment, at least one of the first club head and the second club head satisfy the relationship:

$$I_{zz} \geqq CG_z * 170$$

where $I_{zz}$ is the rotational moment of inertia about a vertical axis and has units of $g/cm^2$ and $CG_z$ is the center of gravity and has units of mm. In this aspect of the invention, the $I_{zz}$ of at least one of the first club head and second club head may be at least about 2500 $g \cdot cm^2$.

In one embodiment, both of the first and second club heads satisfy the relationship: $I_{zz} \geqq CG_z*170$, where Izz is the rotational moment of inertia about a vertical axis and has units of $g/cm^2$ and $CG_z$ is the center of gravity and has units of mm. In this aspect of the invention, the $I_{zz}$ of both the first and the second club heads is at least about 2500 $g \cdot cm^2$. In one embodiment, the second club head satisfies the relationship $I_{zz} \geqq CG_z*SG*17$, wherein SG is the fourth specific gravity. In another embodiment, the first club head satisfies the relationship $I_{zz} \geqq CG_z*SG*130$, wherein SG is the second specific gravity. In addition, at least one of the recesses in the first club head and second club may extend from the heel around the top line-toe transition.

BRIEF DESCRIPTION OF THE DRAWINGS

Further features and advantages of the invention can be ascertained from the following detailed description that is provided in connection with the drawing(s) described below.

DETAILED DESCRIPTION OF THE INVENTION

The present invention is directed to a golf club head with a top line insert. The top line insert may be fashioned in a variety of ways according to the invention. For example, in one embodiment, a recess and optional insert is located in the top line of the club head and extends along the top line. In another embodiment, the recess and optional insert extends around the toe of the club head. The insert may be formed of a variety of materials. For example, the insert may be lighter than the body of the club head to adjust the center of gravity downward. Alternatively, the insert may be heavier than the body of the club head to adjust the center of gravity upward. Each of the various embodiments are discussed in greater detail below and demonstrated with representative drawings.

The recess and optional insert may be used in a variety of club heads. For example, the club head may be a long iron, a short iron, or a set including both long and short irons where the recess and optional insert is tailored to adjust the club head center of gravity and other club head properties such as moment of inertia. In addition, the present invention is contemplated for use with utility-type club heads and putter club heads.

Figure 1:
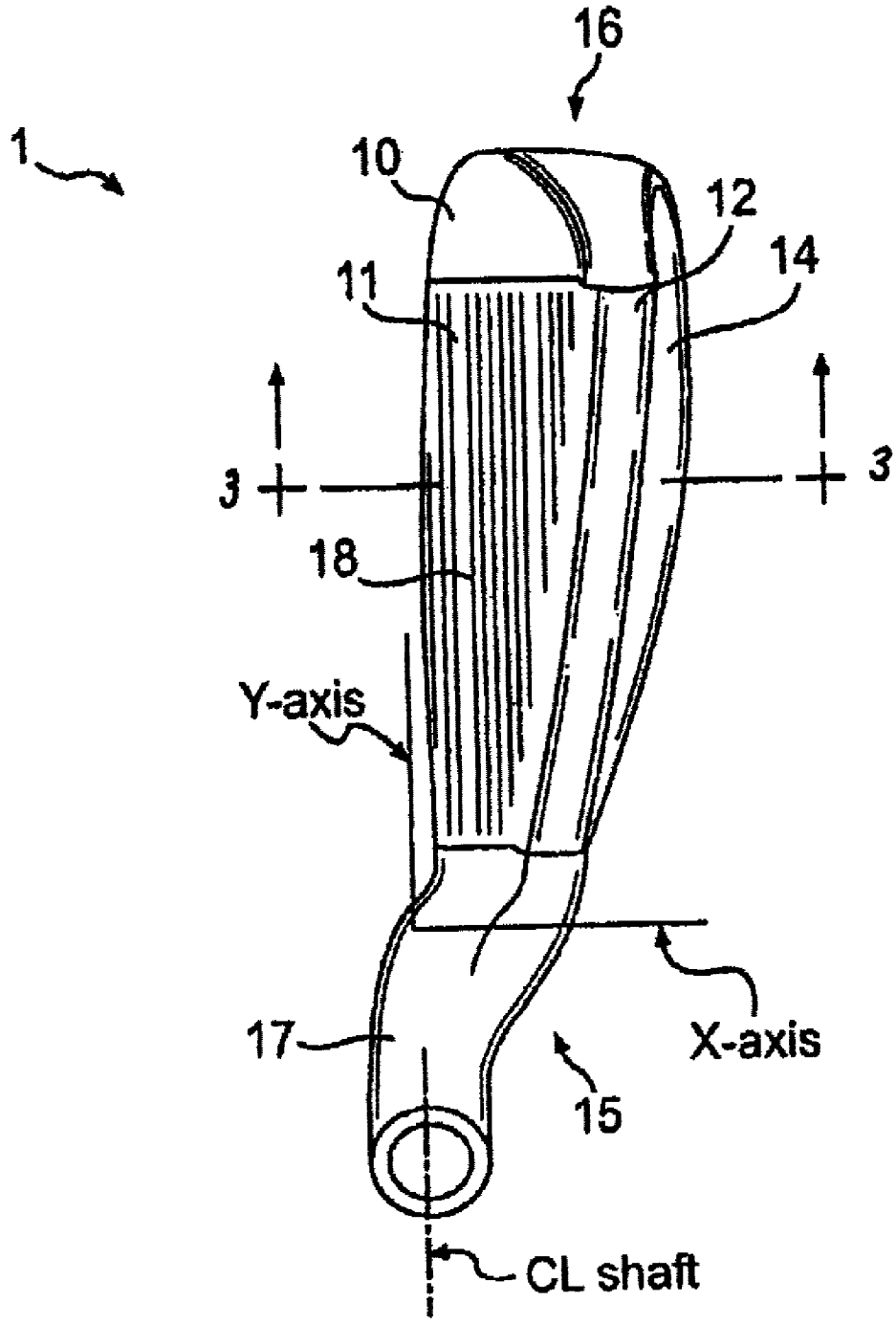
FIG. 1 is a top view of a golf club head of the present invention.
Figure 2:
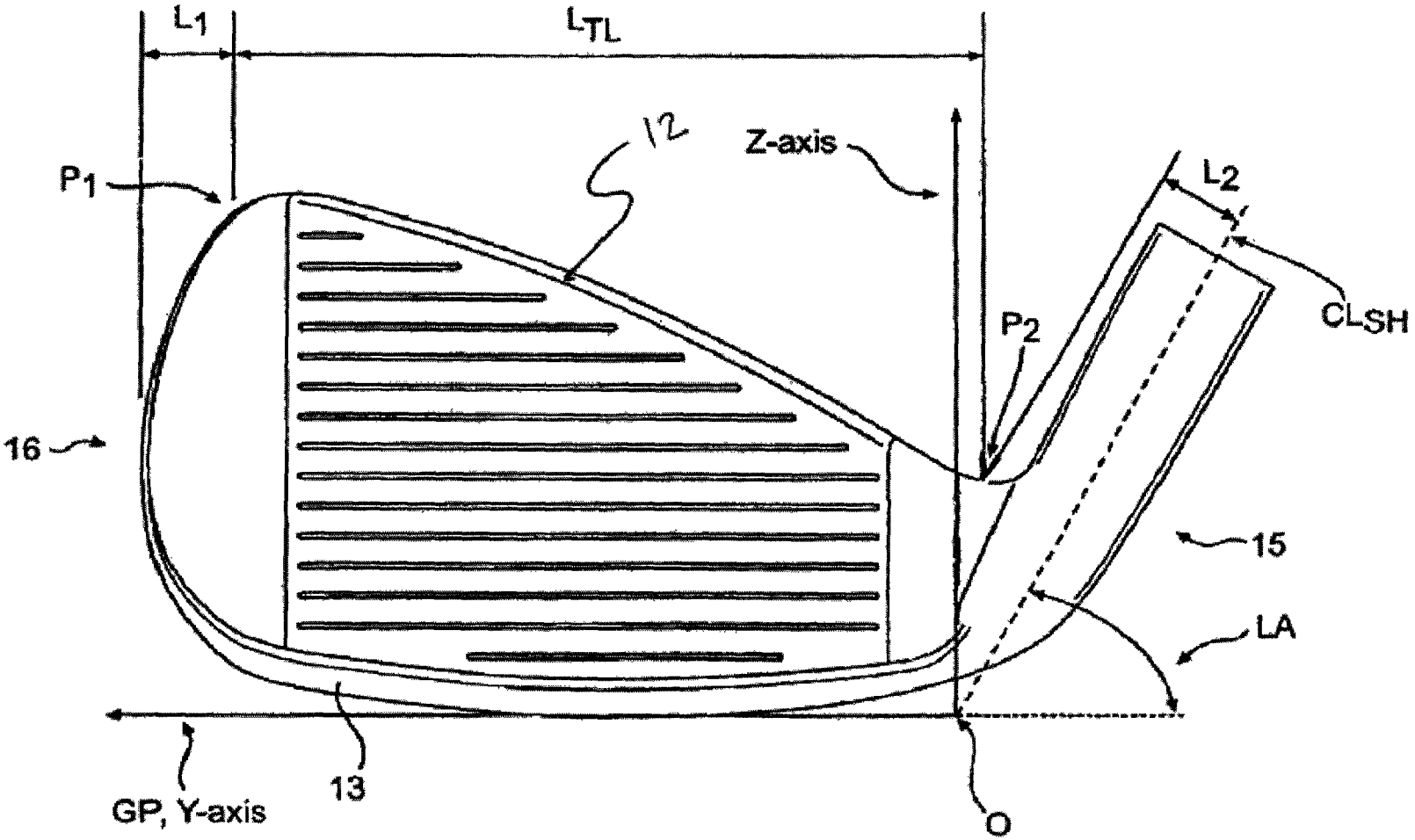
FIG. 2 is a front view of the golf club head of FIG. 1.

FIG. 1 is a top view of a golf club head 1 of the present invention and FIG. 2 is a front view of the golf club head 1. The golf club head 1 includes a body 10 defining a front surface 11, a top line 12, a sole 13, a back 14, a heel 15, a toe 16, and a hosel 17. The striking face of the front surface 11, which preferably contains grooves 18 therein, and the sole 13 may be unitary with the body 10, or they may be separate bodies, such as inserts, coupled thereto. While the club head 1 is illustrated as an iron-type golf club head, as briefly discussed above, the present invention may also pertain to a utility-type golf club head or a putter-type club head.

FIGS. 1 and 2 define a convenient coordinate system to assist in understanding the orientation of the golf club head 1 and other terms discussed herein. An origin O is located at the intersection of the shaft centerline $CL_{SH}$ and the ground plane GP, which is defined at a predetermined angle from the shaft centerline $CL_{SH}$, referred to as the lie angle LA, and tangent to the sole 13 at its lowest point. An X-axis is defined as a vector that is opposite in direction of the vector that is normal to the face 11 projected onto the ground plane GP. A Y-axis is defined as the vector perpendicular to the X-axis and directed toward the toe 16. A Z-axis is defined as the cross product of the X-axis and the Y-axis.

Figure 3:
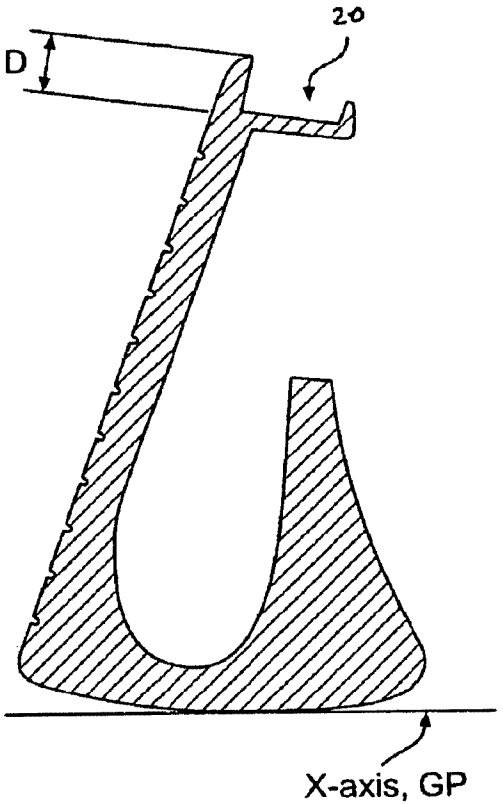
FIG. 3 is a cross-sectional view of the golf club head of FIG. 1 taken along lines 3-3.

As shown in FIGS. 2 and 3, the top portion of the club head contains a recess 20 therein, located between the heel 15 and the toe 16 and extending toward the sole 13. In this aspect of the invention, the recess 20 is preferably located in the top line 12 of the club head 1 and extends along the top line 12. The recess 20 removes material from the club head and, thus, allows redistribution of the material to other areas of the club head to do one or more of the following: increase the overall size of the club head 1, expand the size of the club head sweet spot, reposition the club head center of gravity, and/or produce a greater moment of inertia (MOI) measured about either an axis parallel to the Y-axis or Z-axis passing through the club head center of gravity.

As known to those of ordinary skill in the art, MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits since less energy is lost during impact from club head twisting. Thus, moving or rearranging mass to the club head perimeter enlarges the sweet spot and produces a more forgiving club. Moving as much mass as possible to the extreme outermost areas of the club head 1, such as the heel 15, the toe 16, or the sole 13, maximizes the opportunity to enlarge the sweet spot or produce a greater MOI.

In one embodiment, the recess 20 is located in the top line 12 of the club head 1 and extends along the top line 12 from about 10 percent to about 95 percent of the top line length. The top line length $L_{TL}$ is defined as the distance along the top line 12 from a point $P_1$ to a point $P_2$. Point $P_1$ is defined as the intersection of the golf club head 1 and a plane that is offset 5.08 mm ($L_1$) from and parallel to a plane defined by the X-axis and the Z-axis tangent to the toe 16 at the toe's furthest point from the origin O along the Y-axis. Point $P_2$ is defined as the uppermost intersection of the club head 1 and a plane that is parallel to the plane formed by the shaft centerline $CL_{SH}$ and the X-axis offset a distance of 7.62 mm ($L_2$) in a direction closer to the toe 16.

In another embodiment, the recess extends along the top line from about 10 percent to about 50 percent of the top line length. In yet another embodiment, the recess extends along the top line from about 15 percent to about 45 percent of the top line length. In still another embodiment, the recess extends along the top line from about 30 percent to about 50 percent of the top line length. The recess may also extend along the top line from about 60 percent to about 95 percent, preferably from about 70 percent to about 95 percent.

In yet another embodiment, the recess completely extends along the top line. For example, the recess extends along 100 percent of the top line length. In another embodiment, the recess extends along the complete length of the top line and wraps around to extend into the toe of the club head. For example, the recess may extend around the top line-toe transition to a point about halfway around the toe of the club head toward the sole.

The recess 20 preferably has a volume of about 0.001 $in^3$ to about 0.2 $in^3$. In one embodiment, the volume of the recess is about 0.005 $in^3$ to about 0.15 $in^3$. In another embodiment, the volume of the recess is about 0.01 $in^3$ to about 0.10 $in^3$. In yet another embodiment, the volume of the recess is about 0.05 $in^3$ to about 0.09 $in^3$.

In relative terms, the recess 20 has a volume that is from about 0.5 percent to about 10 percent of the volume of the body 10. In one embodiment, the recess has a volume of about 1 percent to about 8 percent of the volume of the body. In another embodiment, the recess has a volume of about 2 percent to about 7 percent of the volume of the body. In still another embodiment, the recess has a volume of about 3 percent to about 5 percent of the volume of the body.

The recess 20 preferably has a depth D from about 0.254 mm to about 6.35 mm. For example, the recess may have a depth D of about 1.27 mm to about 5.08 mm. In one embodiment, the depth D of the recess is about 2.032 mm to about 3.81 mm. In still another embodiment, the recess has a depth D of about 2.54 mm to about 5.08 mm.

The recess may have a varying depth. For example, in one embodiment, a first portion of the recess has a depth $D_1$ of about 10 percent to about 90 percent of the depth $D_2$ of a second portion of the recess. In one embodiment, a first portion of the recess has a depth $D_1$ about 20 percent to about 80 percent of the depth $D_2$ of a second portion of the recess. For example, when the recess extends around the toe toward the sole, the first portion may be the portion that extends from the toe toward the sole and the second portion may be the portion that extends along the top line of the club. In an alternate embodiment, the recess has a constant depth.

Figure 4:
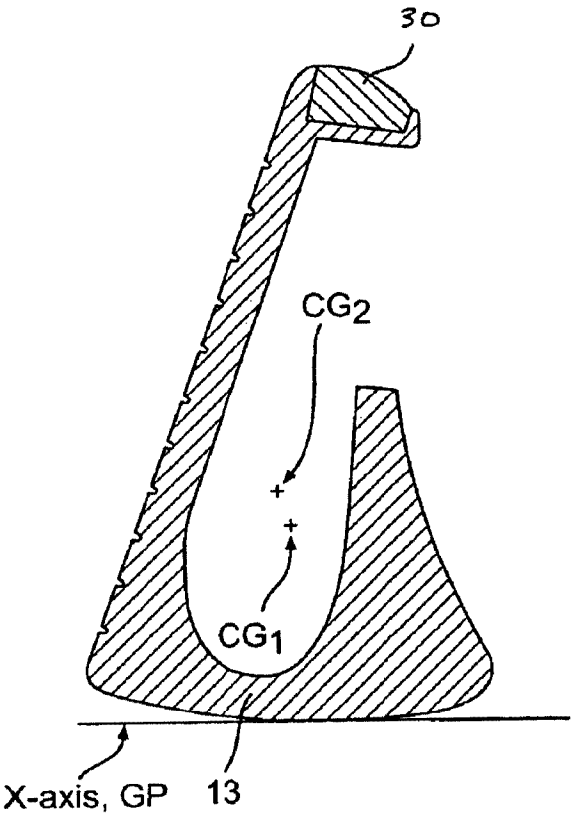
FIG. 4 is a cross-sectional view of the golf club head of FIG. 1, including a low density insert, taken along lines 3-3.

As generally shown in FIG. 4, an insert 30 may be positioned within the recess 20. The insert 30, which may be either a preformed insert or cast in place within the recess 20, may be configured to matingly correspond to the recess 20. That is, the insert 30 may be formed and configured to match the contours of the recess 20 and to substantially fill the recess 20. Alternatively, the insert 30 fills only a portion of the recess 20. In addition, the insert may be a single piece or may be formed from at least two pieces that are not connected. For example, a the insert may be at least two separate inserts that are used to fill portions of the recess 20. The separate portions may be formed of the same material or different materials. For example, when the recess extends around the top line-toe transition to a point in the toe of the club head, a first insert may be selected for at least a portion of the top line length and a second recess may be selected for the portion of the recess found in the toe of the club head.

In one embodiment, the insert 30 has a density that is less than the density of the club head body 10. As used herein, "density" is also intended to relate to "specific gravity". For example, because specific gravity is merely the ratio of the density of a given solid or liquid substance to the density of water at a specific temperature and pressure, these terms are used interchangeably when discussing the relative density or specific gravity of the insert as compared to other portions of the club (such as the body) or other inserts in the club. Since the mass of the insert 30 is less than the mass removed by the recess 20, the extra mass may be replaced in more desirous locations on the club head 1. These locations may include, for example, the club head perimeter and/or the sole 13. Alternatively, no additional mass is added to the club head 1; rather, only the recess 20 and the insert 30 are used to enhance the playing characteristics of the golf club.

A body's center of gravity is determined by its weight distribution. Mass added or removed directly on the center of gravity will have no effect on the center of gravity's location. In contrast, mass added or removed far away from the center of gravity will have the greatest effect on moving the center of gravity. Removing mass from the highest areas of a club head will have the greatest effect on lowering the center of gravity. Adding the mass removed from the high areas to the bottom of the club head will further lower the center of gravity. The top line area and top-of-hosel area are the two highest vertical areas in relation to the ground plane on an iron-type head (when the head is at the address position). By removing the top line portion of the face from the casting and replacing it with, for example, a lightweight viscoelastic piece, anywhere from 20-50 grams are removed from the top of the head, depending upon the design of the viscoelastic piece. That weight is redistributed to the bottom portion of the club, lowering the center of gravity even further versus that same club head constructed entirely of a metallic material, such as steel.

MOI is also a property that is affected by mass distribution. Bodies that have mass distributed far from the center of gravity have higher MOI's about their center of gravity than bodies that have mass concentrated near their center of gravity. Removing the mass from the top of the face lowers the MOI about the center of gravity with respect to certain axes. The axis of rotation that relates to an iron's forgiveness is rotation in the heel-toe direction about the center of gravity—an axis parallel to the Z-axis. A higher MOI about this axis indicates greater resistance to twisting on off-center hits and, thus, more forgiveness. By adding the mass removed from the top line 12 back into the low-heel and low-toe areas of the club head, the reduction in MOI in the heel-toe direction due to removal of metallic material from the top line 12 is minimized.

In this aspect of the invention, the insert 30 may have a density from approximately 0.5 $g/cm^3$ to approximately 5 $g/cm^3$, and is preferably less than the body density by at least about 3 $g/cm^3$. For example, a low density insert may have a density between about 1.2 $g/cm^3$ to about 2 $g/cm^3$. Preferably, the specific gravity of the insert in this embodiment is less than 1.5 $g/cm^3$. Ideally, the specific gravity of the insert in this embodiment is less than 1.3 $g/cm^3$.

In one embodiment, the density of the insert is less than the body density by at least about 4 $g/cm^3$. In another embodiment, the density of the insert is less than the body density by at least about 5 g/cm$^3$. The net effect of creating the recess 20 and adding the lower density insert 30 lowers the club head center of gravity ($CG_1$ in FIG. 4) at least about 0.254 mm toward the sole 13, as compared to the center of gravity location of a club head without the recess 20 and the insert 30 ($CG_2$ in FIG. 4). That is, the golf club head 1 has a center of gravity located at least 0.254 mm from a center of gravity location for a substantially similar golf club head without the recess 20 and the insert 30. More preferably, the club head center of gravity is lowered at least 1.0 mm toward the sole 13. Ideally, the club head center of gravity is lowered at least 2 mm toward the sole 13.

Suitable materials for a low density insert include, but are not limited to, nylon, glass fiber reinforced nylon, polyurethane, polyurea, bulk molding compound, thermoplastics, thermosets, resins, and combinations thereof.

Table 1 shows a comparison of center of gravity locations and MOI's for a 6-iron having a urethane insert 30 to a similar club head formed completely of steel. Note that the measurements presented in Table 1 do not include any weights that may be added to the club head.

TABLE 1

| | 6-iron with Urethane Top Line | 6-iron with Steel Top Line |
|---|---|---|
| Head mass (g) | 238.3 | 240.2 |
| Top line mass (g) | 4.9 | 31.1 |
| Total mass (g) | 243.2 | 271.3 |
| $CG_Y$ (mm) | 34.4 | 35.48 |
| $CG_Z$ (mm) | 19.46 | 21.89 |
| $CG_X$ (mm) | 12.14 | 13.54 |
| $I_{yy}$ (g · cm$^2$) | 541 | 740 |
| $I_{zz}$ (g · cm$^2$) | 2588 | 2764 |
| $I_{xx}$ (g · cm$^2$) | 2832 | 3110 |

$CG_x$, $CG_y$, and $CG_z$ are the x-, y-, and z-components of the center of gravity location, respectively. $I_{xx}$, $I_{yy}$, and $I_{zz}$ are the MOI's about the x-, y-, and z-axes, respectively.

In the alternative, the insert 30 may have a higher density than the body. For example, the insert 30 may have a density greater than about 5 g/cm$^3$, preferably greater than about 7 g/cm$^3$, and more preferably greater than about 9 g/cm$^3$, and is preferably more than the body density by at least about 1 g/cm$^3$. For example, the insert may have a density of about 12 g/cm$^3$ to about 15 17 g/cm$^3$, preferably about 13 g/cm$^3$ to about 16 g/cm$^3$, and more preferably about 14 g/cm$^3$ to about 15 g/cm$^3$. In one embodiment, the density of the insert is greater than the body density by at least about 2 g/cm$^3$, preferably about 3 g/cm$^3$ or more, more preferably about 4 g/cm$^3$ or more, and even more preferably about 5 g/cm$^3$ or more.

Figure 5:
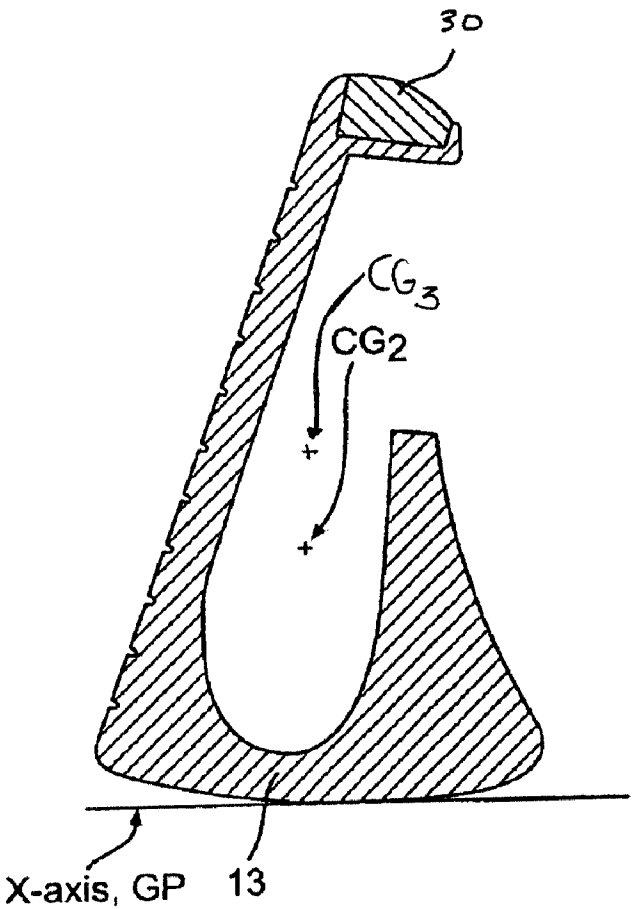
FIG. 5 is a cross-sectional view of the golf club head of FIG. 1, including a high density insert, taken along lines 3-3.

Without being bound to any particular theory, adding mass to the top line raises the center of gravity and the moment of inertia of the club head. In particular, the net effect of creating the recess 20 and adding the higher density insert 30 raises the club head center of gravity ($CG_3$ in FIG. 5) at least about 0.254 mm toward the top of the club head, as compared to the center of gravity location of a club head without the recess 20 and the insert 30 ($CG_2$ in FIG. 5). That is, the golf club head 1 has a center of gravity located at least about 0.254 mm above a center of gravity location for a substantially similar golf club head without the recess 20 and the insert 30. More preferably, the club head center of gravity is raised at least 0.635 mm toward the top of the club head. In this aspect of the invention, the club head center of gravity may be raised about 0.762 mm above a center of gravity location for a substantially similar golf club head without the recess 20 and the insert 30.

In this aspect of the invention, the recess 20 and the insert 30 may increase the club head MOI measured about an axis parallel to the Z-axis and passing through the center of gravity by at least 20 gm·cm$^2$. That is, the club head 1 has an increase in MOI measured about a vertical axis passing through the center of gravity of at least 20 gm·cm$^2$ compared to a substantially similar golf club head without the recess 20 and the insert 30. Thus, the recess 20 and insert 30 produce a more forgiving and playable golf club.

Suitable materials for the high density insert include, but are not limited to, powdered tungsten, a tungsten loaded polymer, and other powdered metal polymer combinations.

Table 2 shows a comparison of center of gravity locations and MOI's for a 6-iron having a tungsten-loaded polymer insert 30 to a similar club head formed completely of steel. Note that the measurements presented in Table 2 do not include any weights that may be added to the club head.

TABLE 2

| | 6-iron with Tungsten-Loaded Polymer Top Line | 6-iron with Steel Top Line | 6-iron with Urethane Top Line |
|---|---|---|---|
| Head mass (g) | 256.7 | 256.7 | 256.7 |
| Top line mass (g) | 14.7 | 7.52 | 1.37 |
| Total mass (g) | 278.31 | 271.13 | 264.98 |
| $CG_Y$ (mm) | 38.68 | 39.04 | 39.04 |
| $CG_Z$ (mm) | 19.05 | 18.52 | 18.06 |
| $CG_X$ (mm) | 12.47 | 12.14 | 11.86 |
| $I_{zz}$ (g · cm$^2$) | 2740 | 2710 | 2684 |

$CG_z$, $CG_y$, and $CG_z$, are the x-, y-, and z-components of the center of gravity location, respectively. $I_{zz}$ is the moment of inertia about the center of gravity parallel to the z-axis. Preferably, the tungsten-loaded top line insert raises the vertical center of gravity by at least about 0.0254 mm when compared to a similar club with a steel top line. In one embodiment, the tungsten-loaded polymer top line insert raises the $CG_z$ by about 0.508 mm or more, preferably about 0.533 mm or more, and even more preferably greater than about 0.635 mm. The moment of inertia $I_{zz}$ of the club head with a high density insert in the top line is at least about 1 percent greater than the moment of inertia $I_{zz}$ of a similar club head with a steel top line. In one embodiment, the $I_{zz}$ of a club head having a heavier insert than the body is increased by about 1.5 percent or more when compared to the $I_{zz}$ of a similar club head with a steel top line.

Furthermore, a club head with a heavier top line insert (such as a tungsten-loaded polymer insert) preferably has a $CG_z$ of at least about 0.508 mm more than a similar club head with a lighter top line insert (such as a urethane insert). For example, the $CG_z$ of a heavier insert club head may be at least about 0.635 mm more, preferably about 0.762 mm or more, and more preferably about 0.889 mm or more, than the $CG_z$ of a lighter insert club head.

Likewise, a club head with a heavier top line insert (such as a tungsten-loaded polymer insert) preferably has a $I_{zz}$ that is at least about 2 percent more than the $I_{zz}$ of a similar club head with a lighter top line insert (such as a urethane insert). For example, the $I_{zz}$ of a heavier insert club head may be at least about 2.5 percent greater than the $I_{zz}$ of a lighter insert club head.

Figure 6:
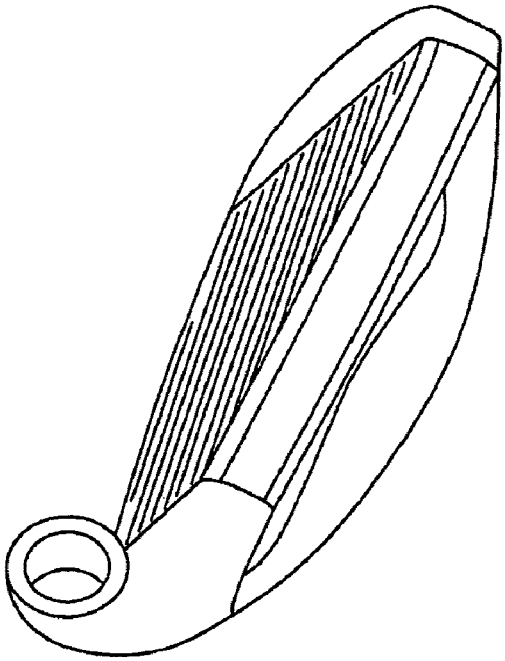
FIG. 6 shows a first isometric view of the golf club head of FIG. 1.
Figure 7:
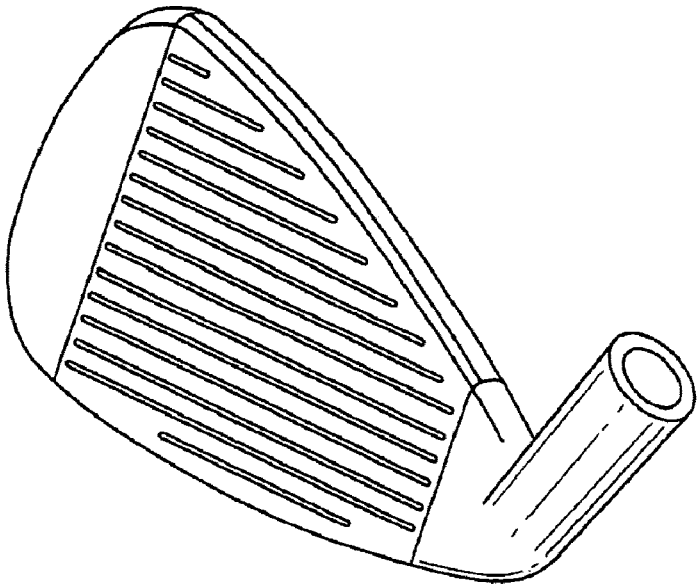
FIG. 7 shows a second isometric view of the golf club head of FIG. 1.

The hardness of the insert will vary depending on the particular material used to form the insert. In one embodiment, the insert has a hardness ranging from about 80 Shore A to about 50 Shore D. In another embodiment, the hardness of the insert ranges from about 20 Shore D to about 50 Shore D. In an alternate embodiment, the hardness of the insert is less than about 20 Shore D. FIGS. 6 and 7 show isometric views of the golf club head 1.

The insert 30 may contain one or more dampening materials, which diminish vibrations in the club head, including vibrations generated during an off-center hit. Preferred dampening materials include those materials known as thermoplastic or thermoset polymers, such as rubber, urethane, polyurethane, butadiene, polybutadiene, silicone, and combinations thereof. Energy is transferred from the club to the ball during impact. Some energy, however, is lost due to vibration of the head caused by the impact. These vibrations produce undesirable sensations in both feel and sound to the user. Because the viscoelastic dampening material of the insert 30 is in direct contact with the metal club head (the vibrating body), it serves to dampen these vibrations, improving sound and feel.

Without being bound to any particular theory, a club with a high center of gravity is likely to impart more spin to the golf ball due to vertical gear effects. This is because an impact made below the center of gravity will increase the spin rate of the ball to help maximize trajectory and distance. An impact made high on the face above the center of gravity will create a higher launch angle, and the vertical gear effect will actually cause the ball to spin less. This can produce greater distance as the ball is subject to less lift or drag that a higher spin creates. Thus, in a typical club set, the higher the loft angle of the club, the lower the center of gravity (as compared to a lower loft angle club). The ability to generate more ball spin for the short irons is an important factor in the golfer's ability to control both the distance of the golf shot, and the distance the ball will roll after the ball hits the green.

However, because the material selection of insert, length, depth, and/or volume of the recess and insert of the present invention allow for adjustments to the center of gravity and moment of inertia, the present invention also contemplates a set of clubs where at least one club is equipped with a low density insert in the club head and at least one club is equipped with a higher density insert in the club head. For example, at least one long iron in the set preferably has a low density insert in the club head as described herein. The term "long irons" refers to 3 and 4 irons (and possibly 1 and 2 irons if application). The club heads on long irons have the least amount of angle, providing primarily distance. In contrast, at least one short iron in the set preferably has a high density insert in the club head. The term "short irons refers to any of the more lofted, shorter-shafted irons (usually considered to include the 8 iron through all wedges).

Due to vertical gear effects, this construction allows for more spin to be imparted to the ball from the short irons, and less spin imparted to the ball for the long irons. The ability to generate more spin in the short irons is an important factor in the golfer's ability to control both the distance of the golf shot and the distance the ball will roll after the ball hits the green.

Figure 8:
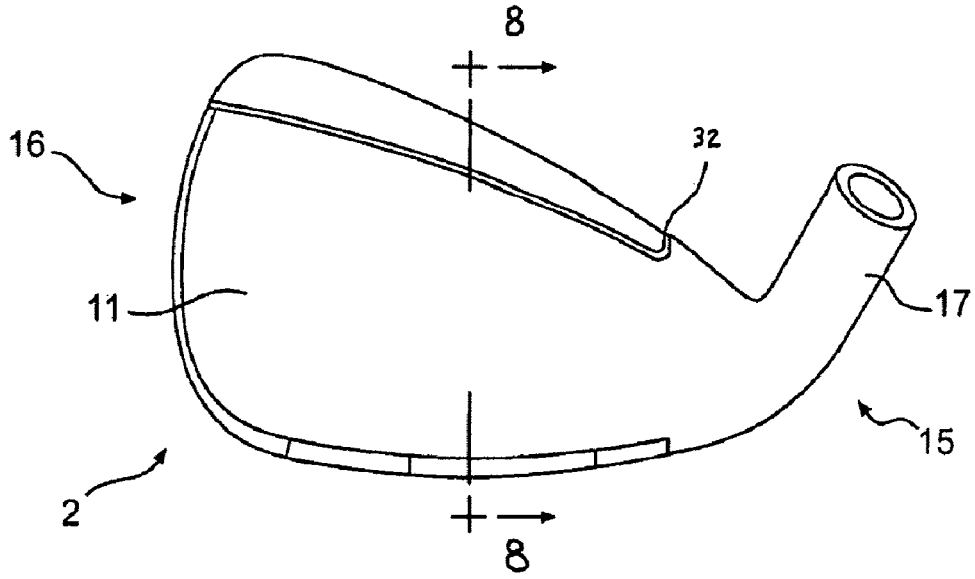
FIG. 8 shows another golf club head of the present invention.
Figure 9:
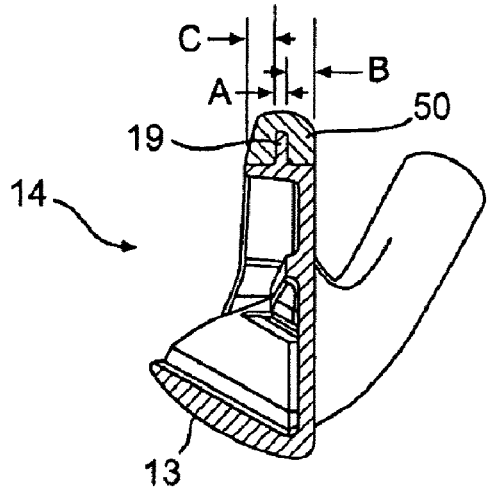
FIG. 9 shows a cross-sectional view of the golf club head of FIG. 8 taken along line 8-8.

FIG. 8 shows another exemplary golf club head 2 of the present invention and FIG. 9 shows a cross-sectional view of the golf club head 2 taken along line 8-8. In this embodiment, material is removed from the metallic club head at the top line 12. Instead of forming a recess at the top line 12, however, a thin protrusion 19 is provided. Metallic material has been removed from the top portion of the club head as described above, and a thin extension 19 is left in place. The insert 50 has a groove corresponding to the protrusion 19. Thus, the viscoelastic material can be fit onto the club head body 10. The insert 50 is attached to the casting, for example, through the use of an epoxy. A fixture with a cavity that matches the outer perimeter shape of the club head 1 should be used to hold the two pieces in place while the epoxy dries. A preferred width A for the protrusion 19 is 1.5 mm. This width ensures adequate structural integrity, though wider protrusions 19 may be used. For example, the width A may range from about 0.76 mm to about 2.54 mm. In one embodiment, the width A ranges from about 1.0 mm to about 2.0 mm. Preferred heights for the protrusion 19 include about 1.5 mm to about 6.4 mm, though other heights may be used. For example, the height of the protrusion may range from about 0.5 mm to about 13.0 mm.

Like the insert that fits within the recess, the insert 50 that fits over the protrusion 19 may be formed of a low density material in order to lower the center of gravity and/or MOI of the club head. In the alternative, the insert 50 may formed of a high density material in order to raise the center of gravity and/or MOI of the club head. The differences between the density of the insert and the body of the club head discussed above with respect to insert 30 also apply in this aspect of the invention.

It is possible that there are variations in size of the metallic portions of the club heads 1, 2 caused during forming and polishing. These variations typically are larger than the variations in size due to molding viscoelastic materials of the inserts 30. To aid in hiding any discrepancy between the two portions of the club head, a groove 32 may be formed in the insert 30 so the edges are visible to the user once the two pieces have been put together. This groove 32 may be created simultaneously with the rest of the insert 30, or as a secondary step. The preferred width and depth of the groove 32 are about 1 mm or less. In one embodiment, the width and depth are about 0.8 mm or less, preferably about 0.75 mm or less, and more preferably about 0.7 mm or less.

In the illustrated example of FIGS. 8 and 9, the protrusion 19 is formed in the center of the top line 12. Alternatively, the protrusion 19 can be formed towards or at the front of the top line 12 or towards or at the rear of the top line 12. The width B of the front portion of the insert 30 may be zero, meaning the protrusion 19 forms the top portion of the face 11. Alternatively, the width B may be, for example, about 0.7 to 6.35 mm. Similar to the width B, the width C of the rear portion of the insert 30 may be zero, meaning the protrusion 19 forms the top portion of the back 14. Alternatively, the width C may be, for example, about 0.7 to 6.4 mm. The height of the insert 30, measured along the longest portion thereof, preferably may be from 0.7 to 7.6 mm.

Use of an insert also has the added benefit of increasing the durability of the club head. For example, over the course of play, clubs carried together in a bag are knocked together. These impacts create marks on the club heads. The top-toe portion of the club is an area that is likely to impact with other clubs. By making that area out of a softer material, the likelihood of creating marks on the head due to club-to-club impacts is reduced.

Figure 10:
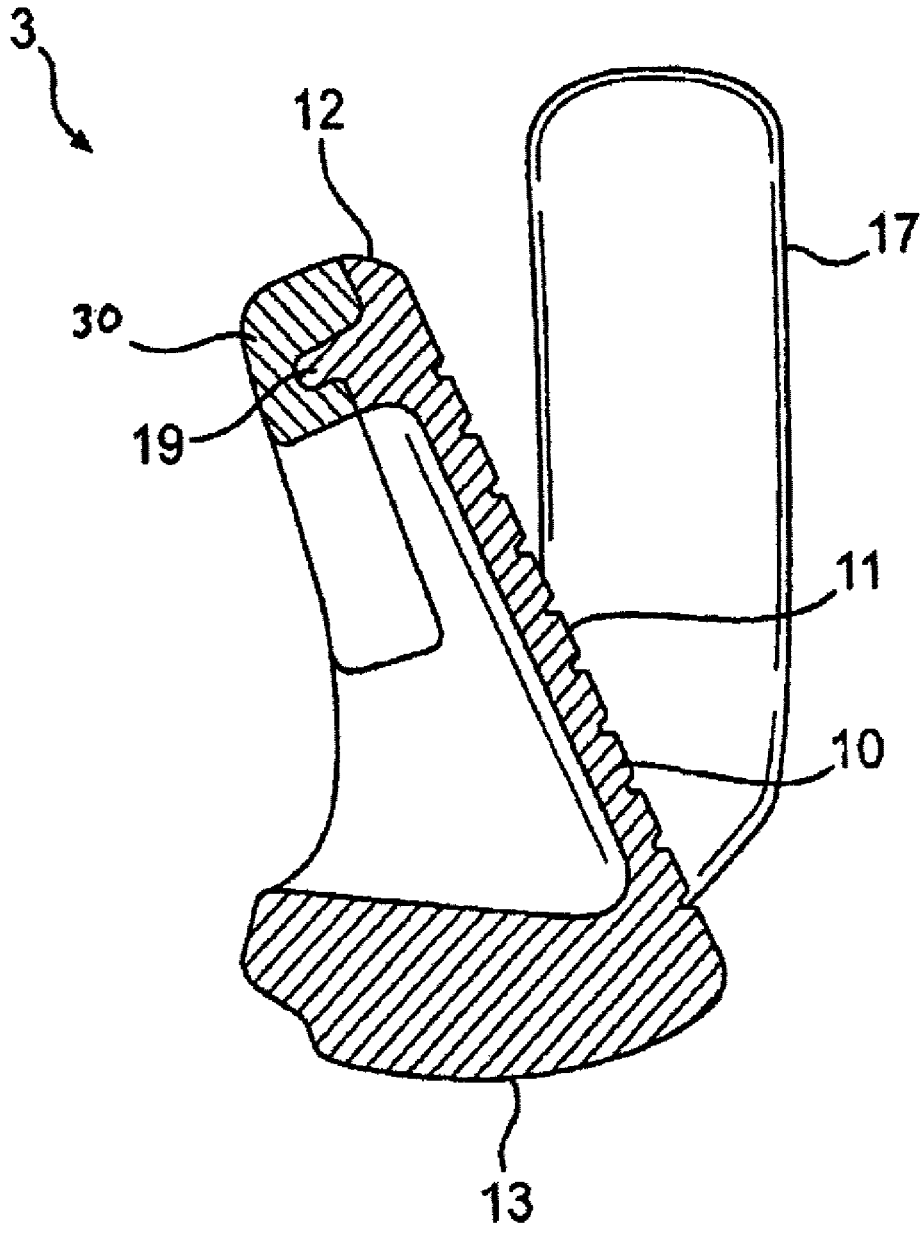
FIG. 10 shows a cross-sectional view of another golf club head of the present invention.

FIG. 10 shows a cross-sectional view of another golf club head 3 of the present invention with the top portion removed. In this embodiment, metallic material has also been removed from the top line 12 and replaced with a light-weight viscoelastic insert 30. A protrusion 19 is also provided in this club head 3, but unlike the previously discussed club head 2, the protrusion is directed backward away from the face 11. The insert 30 contains a groove corresponding to the protrusion 19. Attachment is facilitated through the protrusion 19 and groove. The metallic face material extends to the upper most portion of the face 11 at the top line 12. Alternatively, the viscoelastic material may extend down the top portion of the face 11, for example, up to 7.6 mm.

As before, the insert in this aspect of the invention may be a different material than a light weight viscoelastic material. For example, the insert may be formed of a higher density material in an effort to adjust the center of gravity upward and increase the $I_{zz}$.

Figure 11:
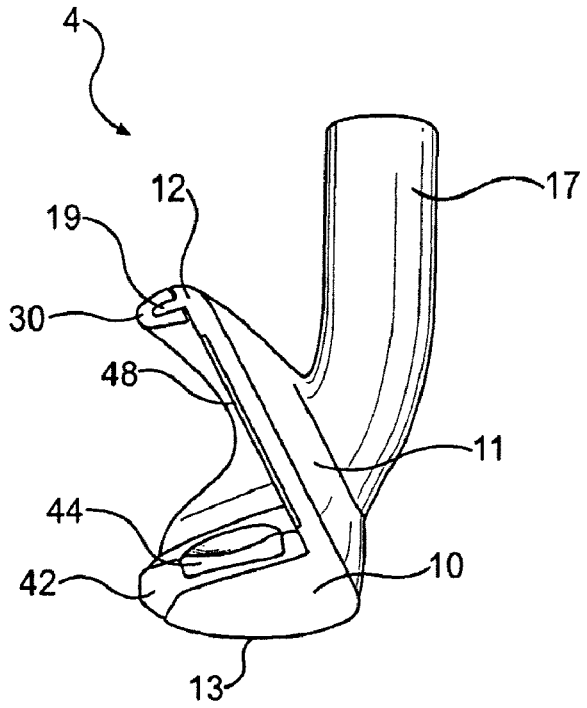
FIG. 11 shows a cross-sectional view of another golf club head of the present invention.
Figure 12:
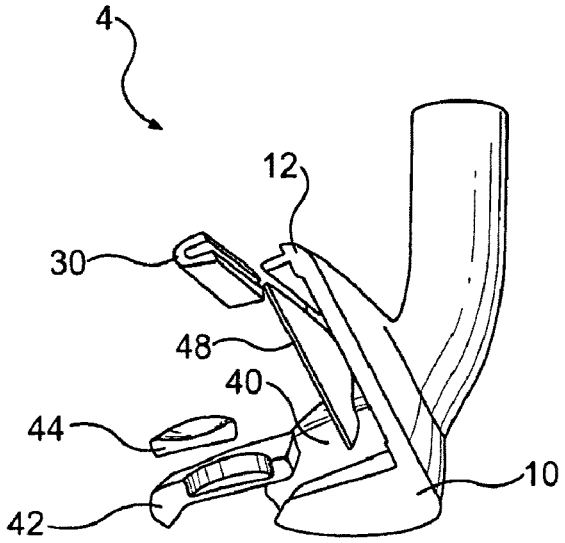
FIG. 12 shows an exploded view of the golf club head of FIG. 11.

FIG. 11 shows a cross-sectional view of another golf club head 4 of the present invention, and FIG. 12 shows an exploded view of the golf club head 4 and its individual components. In this embodiment, metallic material has also been removed from the top line 12 and replaced with an insert 30. Similarly to the previously discussed embodiments, the insert 30 preferably is coupled to the club head 4 via a protrusion 19. In the illustrated embodiment, the protrusion 19 extends rearward from the body 10 near the top 12 of the club head 4, and the entire front surface 11 of the club head 4 is formed of a metallic material. Metallic mass is removed from the rearward side of the top 12 behind the front surface 11. The protrusion 19 can be positioned at any desired location towards the top 12 of the club head 4. The insert 30 is formed of a material, such as nylon, having a high strength-to-weight ratio and a high impact strength-to-weight ratio. These properties ensure that the insert 30 provides a solid feel to the club head 4 while achieving the benefits, discussed above, of removing metallic material from the top line 12.

In this aspect of the invention, the insert material preferably has the following properties at 50% relative humidity and 73° F.: tensile strength of 15 kpsi to 20 kpsi, 17.5 kpsi being preferred; flexural modulus of 650 kpsi to 750 kpsi, 600 kpsi being preferred; notched impact strength of 3 ft·lb/in to 4 ft·lb/in, 3.5 ft·lb/in being preferred; and specific gravity of 1.25 to 2, 1.4 being preferred. These properties and measurement methods are discussed in ASTM D 638, ASTM D 790, ASTM D 256, and ASTM D 792, respectively, which are incorporated herein by reference. One preferred material for the insert 30 of this embodiment is a 33% glass reinforced nylon 66. Zytel® 74G33L NC 010 from DuPont is a preferred nylon. This product meets the preferred physical properties and allows the club designer to provide a top line 12 with a surface finish similar to that of an all steel club head, which may be beneficial to some golfers. More or less glass reinforcement may be used. In particular, while 25 percent to 50 percent is a preferred range for glass (including fiberglass) reinforcement in the nylon material of the insert 30, other amounts may be used. In addition, other reinforcing materials other than glass may also be used.

The club head 4 of FIG. 11 further includes a recess 40 in the upper portion of the sole 13 between the heel 15 and the toe 16. By this recess 40, additional metallic material is removed from the central portion of the club head, further biasing mass towards the club head perimeter and allowing mass to be redistributed to more beneficial locations of the club head 4. The recess 40 may extend completely through the sole 13, or only partially into the sole 13. A second insert 42, preferably formed of a viscoelastic material, may be included within the recess 40. This insert 42 provides a filled-in look to the club head 4, and may further reduce or eliminate unwanted vibrations. A medallion 44 or other weight member may be included in the second insert 42. Inclusion of a weight member 44 coupled to the insert 42 opposite the body 10 of the club head 4 creates a constrained-layer damping system to dissipate unwanted vibrations generated during use of the golf club. The insert 42 and weight member 44 are coupled in known fashion, such as through use of an adhesive. Mechanical fasteners may also be used, alone or in conjunction with an adhesive. The insert 42 may include a recess in which the weight member 44 is attached, providing a smooth transition between the insert 42 and the weight member 44.

A third insert 48 may also be included with the club head 4. This third insert 48 preferably is coupled to the back 14 of the club head 4, opposite the front surface 11. The insert 48 preferably is formed of a viscoelastic material, and thus it damps unwanted vibrations via free-layer damping. The insert 48 may be coupled to the club head 4 in any known manner, such as via an adhesive. The insert 48, as well as the other inserts described herein, may also inherently possess adhesive properties such that it may coupled directly to the club head without the need of a separate adhesive material.

Figure 13:
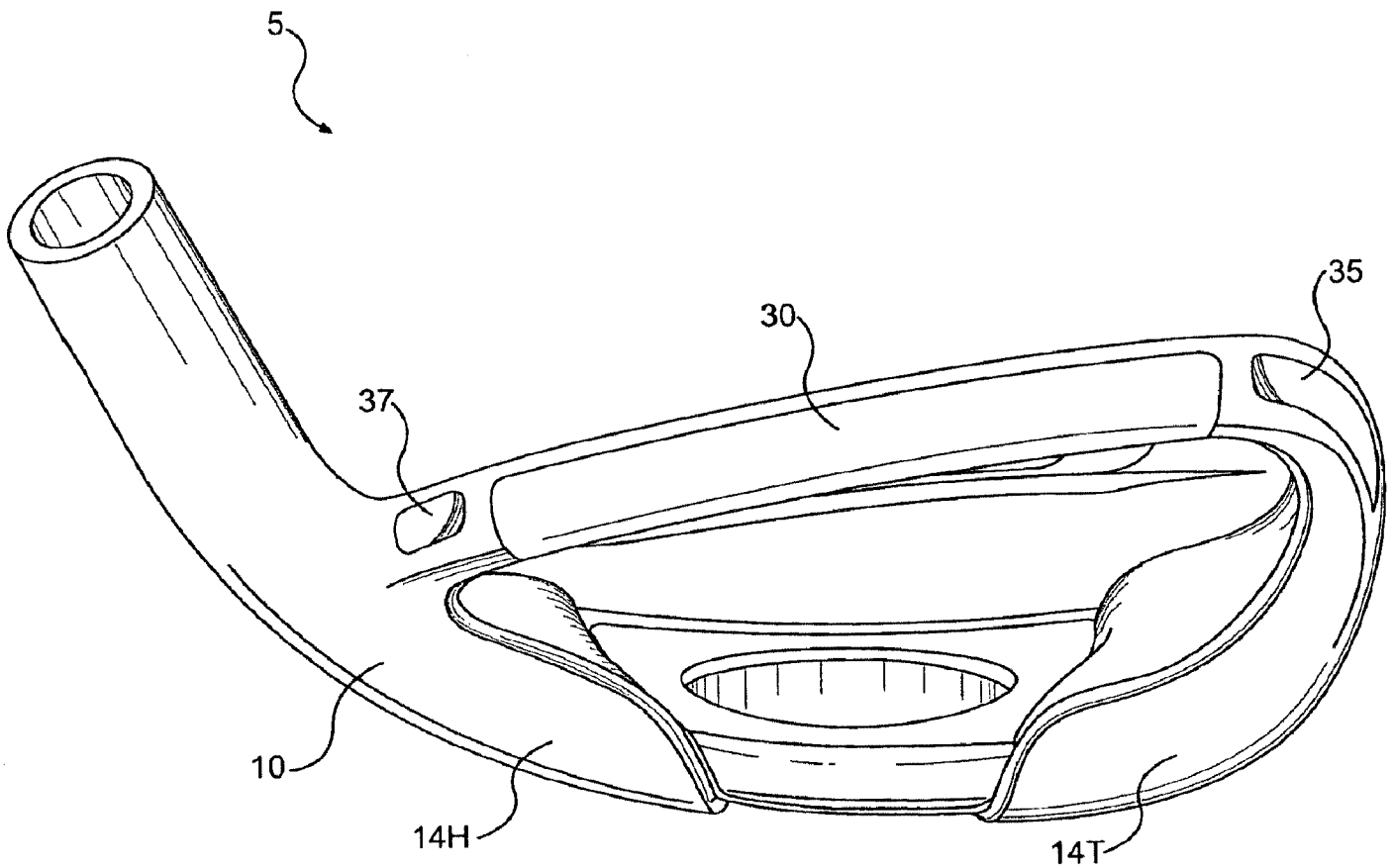
FIG. 13 shows a top, rear view of a golf club head of the present invention.

In addition to removing mass from the central portion of the top line 12, additional material, and therefore mass, may be removed from heel and toe portions of the top line 12. FIG. 13 shows a top, rear view of a golf club head 5 of the present invention. The club head 5 illustrated here shows a central top line insert 30 made of a light weight material as described above, for example a polymer such as polyurethane or a nylon, that replaces metal material that is traditionally located in this portion of the club head. In addition, the club head body 10 illustrated in FIG. 13 defines a recess in the upper toe portion of the club head into which a light weight insert 35 is positioned. Preferably, this recess stretches around the top line-toe transition, shown in the illustrated club head as being a curved transition. Alternatively, toe insert 35 may be positioned such that it is located intermediate the top line and the sole of the club, allowing for toe insert 35 to be hidden from the golfer's view when the club is at address position. Additionally, the club head body 10 illustrated in FIG. 12 defines a recess in the upper heel portion of the club head into which a light weight insert 37 is also positioned. The toe and heel recesses preferably extend completely through the top line 12 to the cavity (assuming here that a cavity back club head is used), but may extend only partially through the club head body 10.

Figure 14:
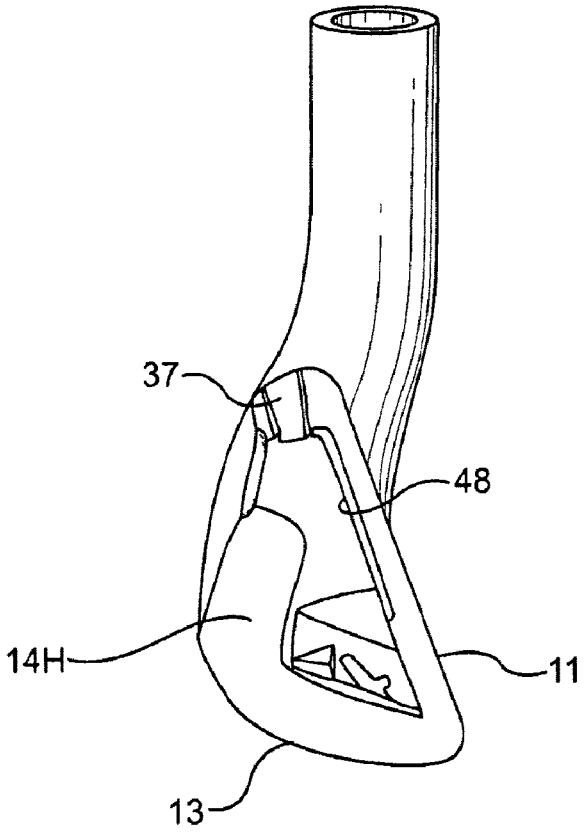
FIG. 14 shows a cross-sectional view through a heel section of the golf club head of FIG. 13.
Figure 15:
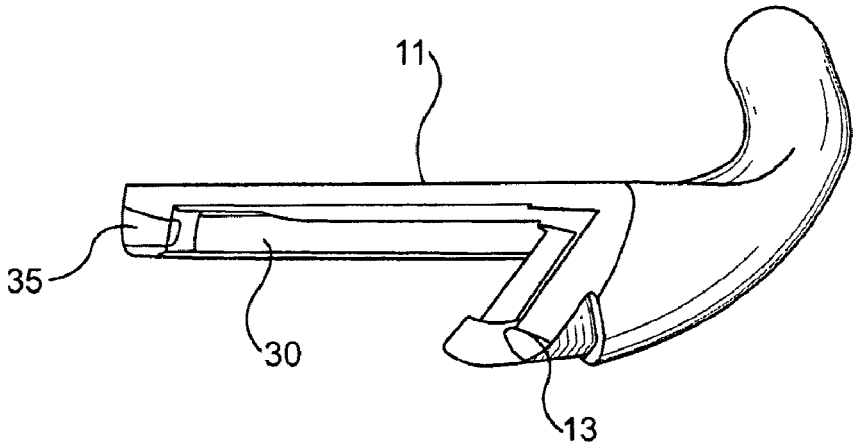
FIG. 15 shows an angled cross-sectional view through the club head of FIG. 14, extending from a mid-sole area to the top line.

As shown in the exemplary club head 5 illustrated in FIGS. 13-15, the toe top line recess preferably is larger than the heel top line recess. This may provide benefits, such as making the club head 5 easier to turn over, or close, during the golf swing. For example, the toe top line recess volume may be from about 1 to about 5 times the heel top line recess volume. Preferably, the central top line recess volume is greater than the toe top line recess volume. The toe and heel inserts 35, 37 may be formed of the same material as the central insert 30, or they may be different. For example, the central insert 30 may be formed of a viscoelastic material to damp vibrations generated during normal use of the resulting golf club, and the toe and heel inserts 35, 37 may be formed of a material that is lighter than the central insert material. Additionally, the toe and heel inserts 35, 37 may be formed of the same material or differing materials.

These toe and heel top line recesses work in conjunction with the central top line recess to remove unneeded club head mass from the upper portion of the club head, which may be repositioned as added mass or weight members in other, more beneficial locations of the club head while keeping the overall club head mass and weight constant. For example, mass may be added to heel and toe portions of the sole, such as by including additional material forming the club head body 10 or by incorporating weight inserts. This beneficially further lowers the club head center of gravity, making the resulting golf club easier to use. Furthermore, repositioning of the "saved" mass and weight to toe and heel portions of the club head further increase the club head MOI, making the club head more stable and forgiving, also increasing the playability of the resulting golf club.

FIG. 14 shows a cross-sectional view through a heel section of the golf club head 5. Weight and mass saved through the use of the heel recess insert 37 has been repositioned into the rear heel portion 14H of the club head 5. Similarly, FIG. 15 shows an angled cross-sectional view through the club head 5, extending from a mid-sole area to the top line 12, substantially perpendicular to and through the center of the toe recess insert 35. As best shown in FIG. 13, the weight and mass saved through inclusion of the toe insert 35 has been repositioned into the rear toe portion 14T of the club head 5. The weighting of the low heel and toe portions may be increased by increasing the height these club head portions extend above the sole 13. Another way the weighting of these portions can be increased is by incorporation of weight inserts in the club head body 10.

Figure 16:
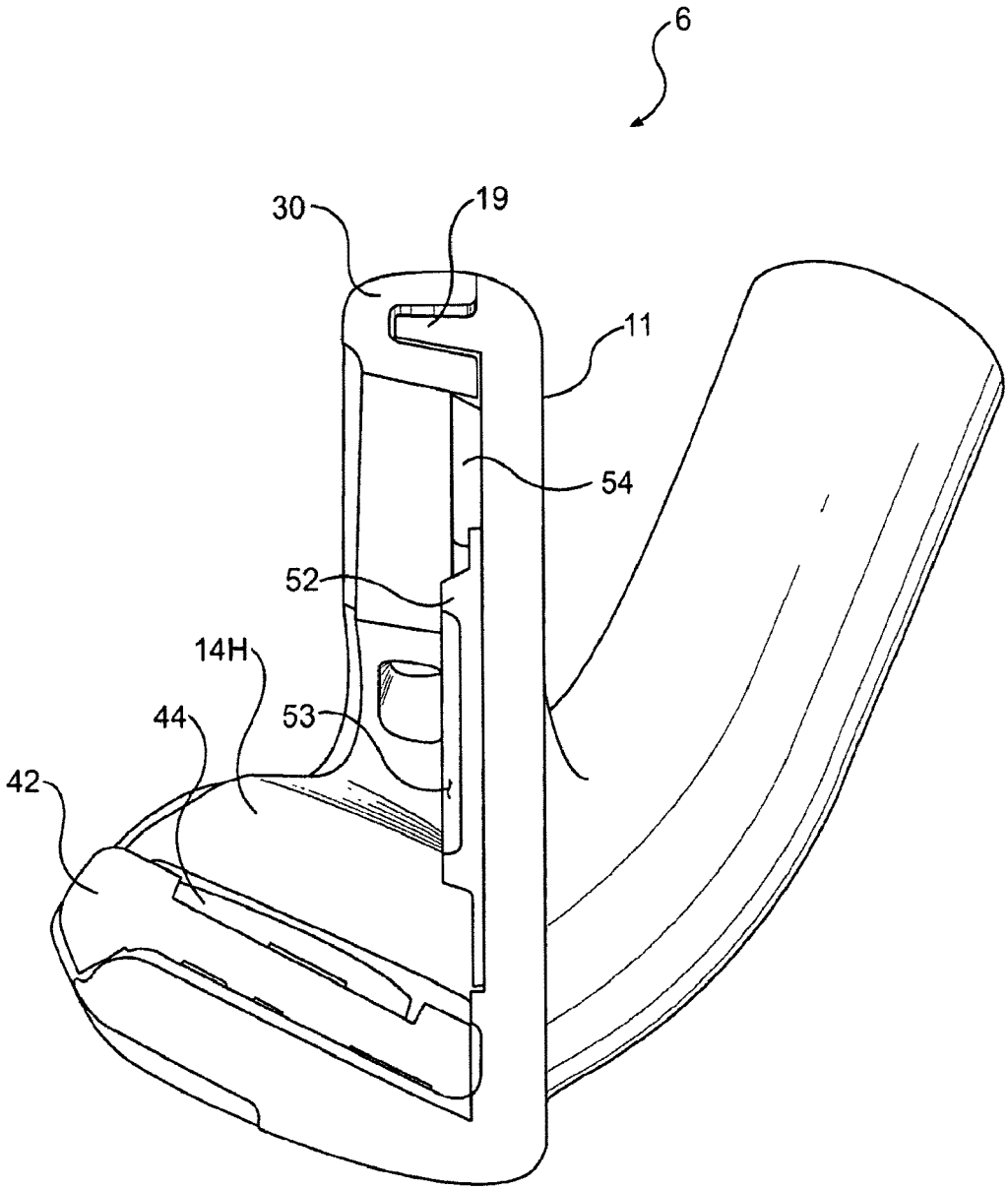
FIG. 16 shows a heel cross-sectional view of a golf club head of the present invention.

FIG. 16 shows a heel cross-sectional view of a golf club head 6 of the present invention. This illustrated club head 6 is similar to the club head 4 illustrated in FIGS. 11 and 12. However, instead of a one-piece insert on the rear surface of the face wall, this club head 6 uses a two-piece insert. A first rear insert 52 is positioned on a lower portion of the rear wall surface, adjacent the insert 42 positioned atop the sole wall. This first rear insert 52 may be formed of a vibration damping material as discussed above with respect to the third insert 48. An additional insert may be included within a pocket 53 defined by a rear surface of the first rear insert 52, which additional insert preferably may be a medallion as described above with respect to the medallion 44 illustrated in FIGS. 11 and 12. In this case, both the first rear insert assembly (first rear insert 52 and its medallion insert) and the sole wall insert assembly (insert 44 and medallion 44) are mass-spring damping systems. Alternatively, the first rear insert 52 itself is a medallion. As shown in FIG. 16, a ridge may be formed in the lower portion of the rear wall surface adjacent the sole wall, extending rearward therefrom, upon which the first rear insert 52 may rest.

In addition to the first rear insert 52, the club head 6 further includes a second rear insert 54. This insert 54 is positioned atop the first insert 52, and includes a notch at its lower end to contact and overlap the first insert 52. As shown in FIG. 16, the notch provides for contact between the rear inserts 52, 54 along two, substantially perpendicular surfaces. Additionally, the second rear insert 54 further includes a tapered top surface. The second insert beneficially may be shaped and dimensioned such that it is longer than the distance from the rear wall ridge to the central top line insert 30. Formed of a viscoelastic material, the tapered upper surface of the second rear insert 54 can be deformed such that it is retained in a state of compression adjacent the rear wall surface. This compressive force is transmitted to the first rear insert 52, helping retain the first and second rear inserts 52, 54 in position. Thus, the rear surface inserts preferably are subjected to and retained in a substantially vertical (that is, in a sole-to-top line direction) compression force. In other words, the second rear insert 54 exerts a downward force upon said first rear insert 52. Retaining the inserts 52, 54 in a state of compression also alleviates any gaps that might otherwise be present due to variances in manufacturing of the club head parts and tolerances. In addition to this compressive force, the inserts 52, 54 may also be coupled, such as through use of an adhesive such as an epoxy, to the rear wall surface as illustrated.

Figure 17:
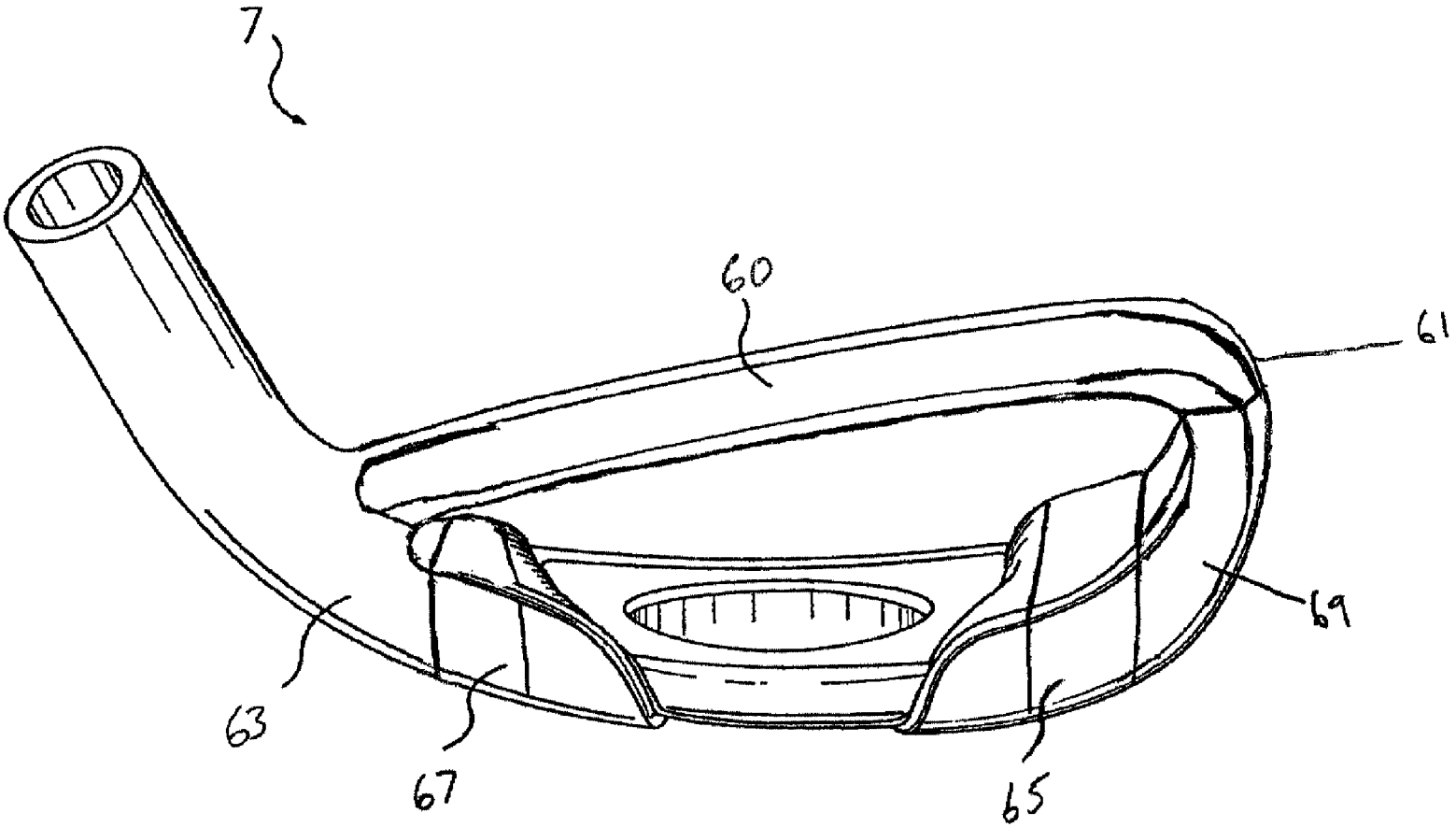
FIG. 17 shows a top, rear view of a golf club head according to an embodiment of the present invention.

FIG. 17 further illustrates a club head of the invention where the recess in the top line extends from the heel portion 63 of the top line around the toe 61. The recess may be of varying or constant depth and volume with the ranges previously discussed. In one embodiment, the depth of the recess varies in at least two portions of the recess by about 10 percent or more. For example, one section of the recess may be about 0.25 mm deep and another section of the recess may be as much as 6.4 mm deep. In another embodiment, the depth of the recess is greater along the length of the top line than at the top line-toe transition. In addition, in this aspect of the invention, the recess may be filled with an insert 60 to reduce or increase mass at the top line depending on the desired center of gravity and moment of inertia as previously described.

FIG. 17 also demonstrates the use of high density weight inserts in other portions of the club head. For example, weight inserts 65 and 67 are located in recesses in the toe and heel portions of the sole. The weight inserts may be positioned in both the toe 65 and the heel 67 portions of the sole to increase the moment of inertia of the club head and lower the center of gravity. The weight inserts 65 and 67 are preferably made of a high specific gravity material, such as tungsten. The weight inserts 65 and 67 preferably have a specific gravity of at least about 7, and preferably greater than about 9. Ideally, the specific gravity of the weight inserts 65 and 67 are greater than the specific gravity of the club head body 69 by at least about 4, and preferably at least about 5.

Figure 18:
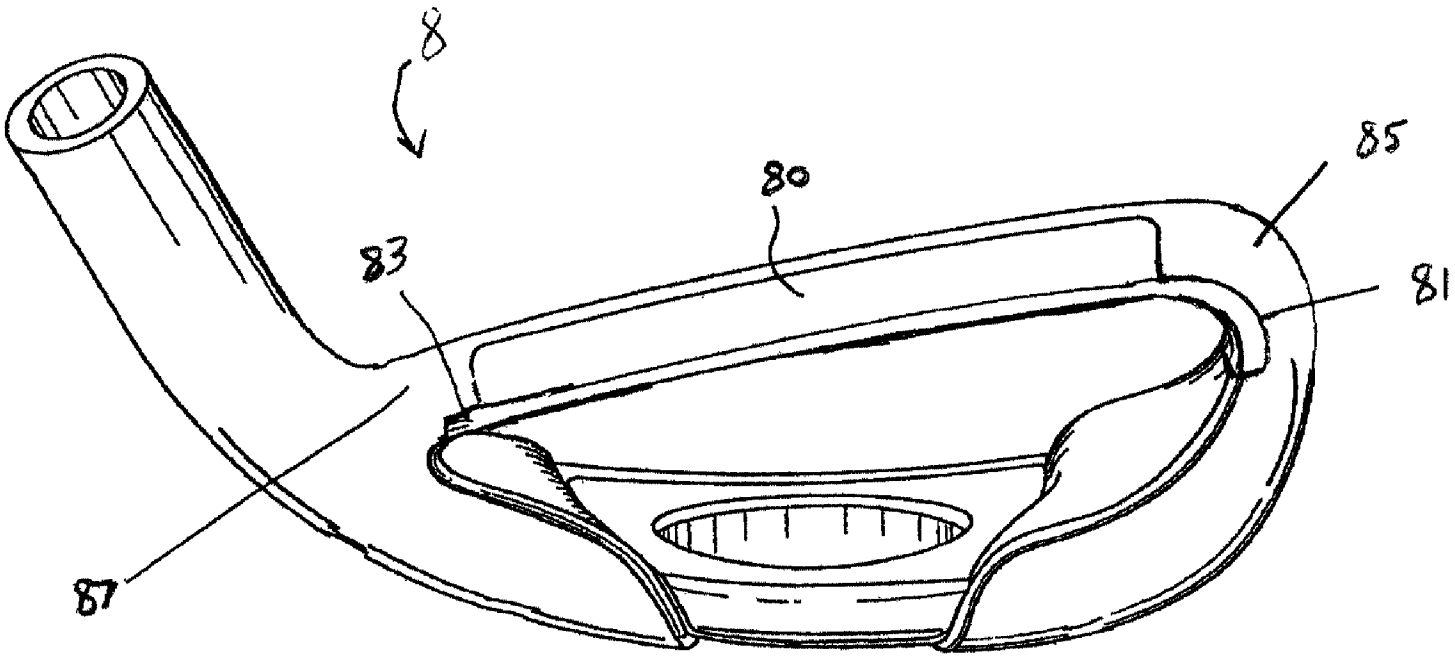
FIG. 18 shows a top, rear view of a golf club head according to an embodiment of the present invention.

In another embodiment of the invention as seen in FIG. 18, a portion of the top line insert 80 is positioned underneath the top line and extends down into the cavity of the club. In particular, the portions of the top line insert 80 that are located under the top line are in the heel 83 and toe 81 sections of the top line. The insert 80 may extend from the heel 83 around the toe 81. However, the only section of the insert 80 that is visible to the golfer when the club is at the address position is the central portion between the heel 87 and the toe 85. The advantage of positioning a portion of the top line insert below the top line is the ease of which the lie and loft may be adjusted. Typically, the lie and loft are adjusted using a device that clamps down on the top line. By setting some of the insert below the metallic top line, regardless of whether a low density or high density insert is employed, the clamp will not damage or disfigure the top line.

Any of the inserts discussed herein including, but not limited to, inserts 30, 35, 37, 50, 60, 65, 67, and 80 may be retained within the respective recesses in known manner, such as through use of an adhesive or epoxy. Alternatively, the inserts of the invention may be molded in place, known as "co-molding." To ensure a smooth top line surface along the entire length of the top line, the top line, with the inserts in place, may be polished. This may be performed, for example, through wet sanding or grinding, which facilitates simultaneous removal of both metallic and polymer/nylon materials. Preferably, the toe and heel recesses are spaced from the central recess by portions of the club head body. This helps ensure that structural integrity of the club head is retained. The insert(s) may also be held in place by utilizing the protrusion configurations generally shown in FIGS. 9, 10-12, and 16.

As previously described, the golf club head of the present invention has a moment of inertia $I_{zz}$ about an axis that passes through the center of gravity and is parallel to the z-axis (as shown in FIG. 2). This axis of rotation relates to the forgiveness of an iron in the heel to toe rotation about the center of gravity. Thus, a higher $I_{zz}$ indicates a greater resistance to twisting on off-center hits, resulting in more forgiveness. As shown in the data in Tables 1 and 2 above, regardless of whether a low density or high density insert is employed, the $I_{zz}$ for the present invention is preferably greater than about 2500 g/cm$^2$.

In addition, the moment of inertia $I_{zz}$ for a club head of the present invention may be related to the vertical center of gravity ($CG_z$) by the following equation:

$$I_{zz} \geqq CG_z * 170 \quad (1)$$

where $I_{zz}$ is in g·cm$^2$ and $CG_z$ is measured in millimeters (mm) in the z-direction.

In one embodiment, the club head satisfies the following relationship between the specific gravity of a low density, light weight top line insert, the moment of inertia $I_{zz}$, and the center of gravity $CG_z$:

$$I_{zz} \geqq CG_z * SG * 130 \quad (2)$$

where specific gravity of the insert is SG, $I_{zz}$ is greater than 2500 and is in g·cm$^2$, and $CG_z$ is measured in millimeters (mm) in the z-direction.

In another embodiment, the club head satisfies the following relationship between the specific gravity of a high density, heavy weight top line insert, the moment of inertia $I_{zz}$, and the center of gravity $CG_z$:

$$I \geqq CG_z * SG * 17 \quad (3)$$

where specific gravity of the insert is SG, $I_{zz}$ is greater than 2500 and is in g·cm$^2$, and $CG_z$ is measured in millimeters (mm) in the z-direction.

A set of club heads including at least one club head with a low density (light weight) and at least one club head with a high density (heavy weight) insert) will preferably have clubs in the set that meet the relationship of all three equations.

The use of the terms "a" and "an" and "the" and similar references in the context of describing the invention are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein.

As used herein, directional references such as rear, front, lower, etc. are made with respect to the club head when grounded at the address position. See, for example, FIGS. 1 and 2. The direction references are included to facilitate comprehension of the inventive concepts disclosed herein, and should not be read or interpreted as limiting.

Other than in the operating examples, or unless otherwise expressly specified, all of the numerical ranges, amounts, values, and percentages, such as those for amounts of materials, moments of inertias, center of gravity locations, and others in the following portion of the specification, may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. An iron-type golf club head, comprising:

a body defining a top line comprising a recess, wherein the body is formed of a first material with a first specific gravity;

the recess having a varying depth in the heel to toe direction;

the body further comprising a striking face, a hosel, a heel, a toe, and a bottommost portion adjacent to the striking face, extending between the hosel and the toe of the club head, defining a sole;

an insert positioned within the top line recess, wherein the top line insert is formed of a second material with a second specific gravity;

wherein the second specific gravity is less than the first specific gravity, and wherein the club head satisfies the relationship:

$$I_{zz} \geqq CG_z \times 170$$

where $I_{zz}$ is the rotational moment of inertia about a vertical axis and has units of g·cm$^2$ and $CG_z$ is the center of gravity and has units of mm;

wherein the top line insert saves an amount of weight that allows the saved weight to be located to the heel and toe of the golf club head.

2. The golf club head of claim 1, further comprising a sole comprising a heel recess and a toe recess and a weight insert positioned within the sole heel recess and the sole toe recess, wherein the weight insert is formed of a third material with a third specific gravity.

3. The golf club head of claim 2, wherein the third specific gravity is at least about 7.

4. The golf club head of claim 2, wherein the third specific gravity is at least about 9.

5. The golf club head of claim 1, wherein the second specific gravity is less than the first specific gravity by at least about 3.

6. The golf club head of claim 5, wherein the club head satisfies the relationship $I_{zz} \geqq CG_z \times SG \times 130$, wherein SG is the second specific gravity.

7. The golf club head of claim 5, wherein the second specific gravity is less than about 1.5.

8. The golf club head of claim 1, wherein $I_{zz}$ is at least about 2500 g·cm$^2$.

9. The golf club head of claim 1, wherein the recess extends from the heel around the top line-toe transition.

10. A set of iron type golf clubs comprising:

at least one club comprising a first club head comprising:

a body defining a top line comprising a recess, wherein the body is formed of a first material with a first specific gravity;

the recess having a varying depth in the heel to toe direction;

an insert positioned within the recess, wherein the insert has a second specific gravity, and wherein the second specific gravity is less than the first specific gravity; and at least one club comprising a second club head comprising:

a body defining a top line comprising a recess, wherein the body is formed of a third material with a third specific gravity;

the recess having a varying depth in the heel to toe direction;

an insert positioned within the recess, wherein the insert has a fourth specific gravity, and wherein the fourth specific gravity is greater than the third specific gravity.

11. The set of claim 10, wherein at least one of the first club head and the second club head satisfy the relationship:

$$I_{zz} \geqq CG_z \times 170$$

where $I_{zz}$ is the rotational moment of inertia about a vertical axis and has units of $g \cdot cm^2$ and $CG_z$ is the center of gravity and has units of mm.

12. The set of claim 11, wherein the $I_{zz}$ of at least one of the first club head and second club head is at least about 2500 $g \cdot cm^2$.

13. The set of claim 10, wherein both of the first and second club heads satisfy the relationship:

$$I_{zz} \geqq CG_z \times 170$$

where $I_{zz}$ is the rotational moment of inertia about a vertical axis and has units of $g \cdot cm^2$ and $CG_z$ is the center of gravity and has units of mm.

14. The set of claim 13, wherein the $I_{zz}$ of both the first and the second club heads is at least about 2500 $g \cdot cm^2$.

15. The set of claim 10, wherein the second club head satisfies the relationship $I_{zz} \geqq CG_z \times SG \times 17$, wherein SG is the fourth specific gravity.

16. The set of claim 10, wherein the first club head satisfies the relationship $I_{zz} \geqq CG_z \times SG \times 130$, wherein SG is the second specific gravity.

17. The set of claim 10, wherein at least one of the recesses in the first club head and second club extend from the heel around the top line-toe transition.

18. An iron-type golf club head, comprising:

a body defining front face, a hosel, a heel, a toe, a bottommost portion adjacent to the front face, extending between the hosel and the toe of the club head, defining a sole, and a top line comprising a recess, wherein the body is formed of a first material with a first specific gravity;

the recess having a varying volume in the heel to toe direction;

an insert positioned within the top line recess, wherein the top line insert is formed of a second material with a second specific gravity;

wherein the second specific gravity is less than the first specific gravity, and wherein the club head satisfies the relationship:

$$I_{zz} \geqq CG_z \times 170$$

where $I_{zz}$ is the rotational moment of inertia about a vertical axis and has units of $g \cdot cm^2$ and $CG_z$ is the center of gravity and has units of mm.

19. The golf club head of claim 18, further comprising a sole comprising a heel recess and a toe recess and a weight insert positioned within the sole heel recess and the sole toe recess, wherein the weight insert is formed of a third material with a third specific gravity.

20. The golf club head of claim 18, wherein the club head satisfies the relationship $I_{zz} \geqq CG_z \times SG \times 130$, wherein SG is the second specific gravity.

* * * * *